US006406824B1

(12) United States Patent
Okamura et al.

(10) Patent No.: US 6,406,824 B1
(45) Date of Patent: Jun. 18, 2002

(54) ELECTROPHOTOGRAPHIC PHOTOSENSITIVE MEMBER AND ELECTROPHOTOGRAPHIC APPARATUS HAVING THE PHOTOSENSITIVE MEMBER

(75) Inventors: Ryuji Okamura; Shigenori Ueda, both of Mishima; Junichiro Hashizume, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/448,599

(22) Filed: Nov. 24, 1999

(30) Foreign Application Priority Data

Nov. 27, 1998 (JP) ..... 10-337939
Nov. 27, 1998 (JP) ..... 10-337943

(51) Int. Cl.[7] ..... G03G 5/147

(52) U.S. Cl. ..... 430/67; 430/66; 430/132; 399/159

(58) Field of Search ..... 430/66, 67, 132; 399/159

(56) References Cited

U.S. PATENT DOCUMENTS

| | | | | |
|---|---|---|---|---|
| 4,664,999 A | | 5/1987 | Kakinuma et al. | 430/64 |
| 4,770,966 A | | 9/1988 | Kazama et al. | 430/66 |
| 5,407,768 A | | 4/1995 | Akiyama et al. | 430/65 |
| 5,514,506 A | | 5/1996 | Takai et al. | 430/57 |
| 5,958,644 A | | 9/1999 | Ueda et al. | 430/128 |
| 6,001,521 A | * | 12/1999 | Hashizume et al. | 430/67 |

FOREIGN PATENT DOCUMENTS

| | | |
|---|---|---|
| EP | 0872770 | 10/1998 |
| JP | 61-219961 | 9/1986 |
| JP | 61-278859 | 12/1986 |
| JP | 61-289354 | 12/1986 |
| JP | 06-317920 | 11/1994 |

OTHER PUBLICATIONS

Diamond, A. S. ed. Handbook of Imaging Materials, Marcel Dekker, Inc., NY (1991), pp. 160–162.*

Database WPI, Sec. Ch, Week 198837, Derwent Publ., AN1988–261641 XP002132539, for JP 63–191152 (1988).

* cited by examiner

*Primary Examiner*—Janis L. Dote
(74) *Attorney, Agent, or Firm*—Fitzpatrick, Cella, Harper & Scinto

(57) ABSTRACT

As the surface layers of an electrophotographic photosensitive member, a first surface layer which satisfies a condition that a center line average surface roughness (Ra) ranges from 50 Å to 5000 Å and a second surface layer comprising a non-single-crystal carbon containing at least fluorine are laminated in this order. Thus, the generation of a defective image such as the dimness of an image or an image smearing can be suppressed under an environment of high temperature and high humidity without providing any heater even when an electrophotographic apparatus is repeatedly employed. Further, even when a toner of small particle size and excellent in its fixing characteristic is used, a cleaning characteristic can be improved and the fusion of the toner can be suppressed. Still further, even in an electrophotographic process with a frictional force raised for improving the cleaning characteristic, the cleaning characteristic can be improved and the fusion of the toner can be suppressed.

16 Claims, 6 Drawing Sheets

ELECTROPHOTOGRAPHIC PHOTOSENSITIVE MEMBER AND ELECTROPHOTOGRAPHIC APPARATUS HAVING THE PHOTOSENSITIVE MEMBER

BACKGROUND OF THE INVENTION

1. Field of the Invention

The present invention relates to a electrophotographic photosensitive member having a deposited film made of a non-single-crystal material on a cylindrical substrate, and more particularly to an electrophotographic photosensitive member which can stably provide an image with high quality for a long period without generating an image dimness and an image smearing under a severe environment such as a high temperature and a high humidity even when the heating means of the electrophotographic photosensitive member is not provided in all electrophotographic processes, and further without generating imperfect cleaning or fusion under all environments.

2. Related Background Art

A non-single-crystal deposited film made of a non-single-crystal silicon (a-Si) or the like compensated by hydrogen and/or halogen (for instance, fluorine, chlorine, etc.) has been proposed and put to practical use as a pollution-free photosensitive member with high performance and high durability. The a-Si photosensitive member has a higher surface hardness than other photosensitive members, exhibits a high sensitivity to a;wavelength light such as a semiconductor laser (600 nm to 700 nm) and the deterioration of the potential characteristic thereof due to repeated use is hardly recognized, so that the a-Si photosensitive member has been widely employed particularly for the electrophotographic photosensitive member of a high speed copying machine or a LBP (laser printer).

With the recent increase of information throughput, a demand for the high speed copying machines or the LBPs has been further increased and the amount of copying for each copying machines has been excessively augmented.

Under these circumstances, the durability of the electrophotographic photosensitive member and the decrease of the deterioration of its potential characteristic due to repeated use have been more requested than before. In order to meet this request, various kinds of studies of the surface layer of the a-Si photosensitive member have been specially carried out. Especially, in recent years, a non-single-crystal carbon (a-C) film has been proposed as a material of the surface layer of the a-Si photosensitive member.

Japanese Patent Application Laid-Open No. 61-219961 discloses a technique that a material composed of a hydrogenated non-single-crystal carbon and 10 to 40 atomic % of hydrogen atom is employed as a surface layer. In accordance with these techniques, electrical, optical and photoconductive characteristics, an environmental characteristic for use and a durability can be improved and further, an image quality can be improved.

Further, Japanese Patent Application Laid-Open No. 6-317920 discloses a method for producing a surface layer made of a non-single-crystal carbon material including carbon,atoms as a matrix by plasma CVD for decomposing feed gas by a glow discharge generated by an electromagnetic wave with frequency of 20 MHZ to 450 MHZ.

When the above described a-Si photosensitive members are applied to the electrophotographic apparatus, an electric latent image is formed on the photosensitive member by charging, discharging and exposure means. Then, the latent image is developed by using a developer (toner), and a toner image is transferred to a transfer material such as a sheet if necessary. After that, the toner image is fixed to the transfer material by heating, pressing, and heating and pressing or solvent steam or the like to obtain a copied product. Further, the toner which is not transferred but remains on the photosensitive member is recovered in a cleaning process and exhausted outside as a waste toner.

As charging and discharging means of the photosensitive member, a corona charger (Corotron, Scotron) is used in most cases. However, in accordance with a corona discharge, ozone ($O_3$) is generated to oxidize nitrogen in air and produce corona discharge products such as nitrogen oxides ($NO_x$). Further, the produced nitrogen oxides react with water content in the air to undesirably produce nitric acid or the like to lower the resistance on the surface of the photosensitive member.

Therefore, a transverse charge holding capacity is entirely or partly lowered so that there is generated a defective image called an image dimness or an image smearing (an electric charge on the surface of the photosensitive member leaks in the direction of a plane so that an electrostatic latent image pattern collapses or is not formed).

In addition, since the corona discharge product adhering to the inner surface of the shield plate of the corona discharger stains the surface of the photosensitive member not only during the operation of the electrophotographic apparatus but also during the stop of the apparatus at night, the image dimness and the image smearing are apt to be generated in areas corresponding to the aperture of the charger during the stop of the apparatus on a first sheet or several hundreds of sheets which are outputted upon restart of the apparatus after the apparatus stops. The above described image smearing looks like the trace of the charger, hence it is referred to as a charger trace smearing.

Further, in case of the a-Si photosensitive member, since the surface hardness thereof is higher than that of other photosensitive members, which reversibly acts, the corona discharge product adhering to the surface of the photosensitive member is liable to remain indefinitely. Thus, there have been proposed two following methods for preventing the image dimness or the image smearing phenomenon.

According to the first method, a heater for heating the photosensitive member itself is housed, or hot air is supplied to the photosensitive member by a hot airblower to heat the surface of the photosensitive member at 30 to 50° C. so that a relative humidity is lowered. This method is a treatment for volatilizing the corona discharge product or moisture sticking to the surface of the photosensitive member to substantially prevent the resistance on the surface of the photosensitive member from being decreased and is put to practical use.

According to the second method, a water repellency on the surface of the photosensitive member is improved so that the corona discharge product hardly sticks to the surface of the photosensitive member from the start, and accordingly the image smearing is prevented. For example, Japanese Patent Application Laid-Open No. 61-289354 discloses the a-C surface layer obtained by applying plasma treatment to a surface with gas including fluorine. Further, Japanese Patent Application Laid-Open No. 61-278859 discloses a method for manufacturing an electrophotographic photosensitive member having a surface layer composed of a-C:H on an a-Si photosensitive layer and specifying a self-bias.

In the meantime, as for a development, toner usually having weight average particle size of about 10 to 12 $\mu$m is often used. Nowadays, however, a more minute and delicate image quality is required, so that the toner of small particle size is needed and the development thereof is hastened.

A capability for fixing the toner image to the transfer material depends on how the toner image on the transfer material is heated in a fixing device. For a speed-up operation, is developed a technique that a fixing characteristic is improved by a low melting point toner.

However, when the fixing characteristic is improved, there occurs a fear that the toner tends to stick to the surface of a drum to form a defective image. Thus, in order to make it difficult for the toner to stick to the photosensitive member, it is necessary to enhance the sliding characteristic of the surface of the photosensitive member as well as a cleaning characteristic for mechanically scraping the toner sticking to the surface of the photosensitive member.

As cleaning. means, are extensively employed a blade type cleaning system with a high cleaning capability and a magnetic roller (a cleaning roller formed with a magnetic brush) or the like in combination.

As methods for meeting a change to the small size of the toner and the high fixing characteristic or the like, are considered countermeasures that the hardness of a blade is raised, the pushing pressure of the blade is increased, and the rotating speed or the rotating direction of the magnetic roller (a forward direction or a reverse direction relative to the photosensitive member) is changed. The fusion and the slip or fall of the toner are prevented on the basis of these countermeasures.

However, according to a method of heating the surface of the photosensitive member to 30 to 50° C. by a heater in order to prevent the image smearing as described above, the consumed power of a copying machine matrix is undesirably increased. Therefore, it may be possibly difficult to operate high speed copying machines within a power of 100V/15 Å, which is the state of a power supply generally employed in ordinary offices.

Further, the heater for heating the photosensitive member cannot be turned off even at night, for the purpose of suppressing the image smearing on the first sheet to several hundreds of sheets upon restart due to ozone products falling and accumulated from the charger during the night. Therefore, an improvement has been desired from the recent energy saving and ecological point of view.

Further, a method of the above described methods for preventing the image smearing by which the corona discharge product seldom sticks to the surface of the photosensitive member from start by improving the water repellency on the surface of the photosensitive member has still a problem to be solved in view of durability. Therefore, the surface of the photosensitive member which is originally rich in durability must have a desired durability of higher level. Accordingly, the conventional electrophotographic apparatus has such problems to be solved as to provide a good image without providing the heating means of the photosensitive member and to eliminate the variation of an image characteristic due to repeated use.

The improvement of the surface feature of the photosensitive member and the cleaning characteristic of the electrophotographic apparatus permits an electrophotographic image to obtain an image quality higher than that obtained so far. However, the improvement of the cleaning characteristic may possibly increase the amount of shaving of the surface of the photosensitive member more than that got hitherto with disadvantage.

Especially, when a-C:F film containing fluorine is used for the surface layer, the sliding characteristic of the surface of the photosensitive member is improved due to fluorine contained in the film. However, this surface becomes softer than that using the a-C film and is more liable to be scraped. Therefore, there occurs sometimes a problem in view of stability due to the repeated use of the photosensitive member.

Accordingly, even in the electrophotographic process whose cleaning characteristic is enhanced, the achievement of a more improved stability in the repeated use of the drum has been required without scraping the drum.

SUMMARY OF THE INVENTION

The present invention has been accomplished by taking the above mentioned problems into consideration and it is an object of the present invention to provide an electrophotographic photosensitive member excellent in its repeated use in an electrophotographic apparatus and an electrophotographic apparatus having the above photosensitive member.

It is another object of the present invention to provide an electrophotographic photosensitive member capable of providing a stable image in which an image dimness or an image smearing or the like is not generated irrespective of an environment even when heating means are not provided and an electrophotographic apparatus having the above described electrophotographic photosensitive member.

It is still another object of the present invention to provide an electrophotographic photosensitive member excellent in its cleaning characteristic even when a toner having a small particle size and an excellent fixing characteristic is used, and in which a problem resulting from the fusion of the toner is not generated, or is negligible and an electrophotographic apparatus having the above described photosensitive member.

In addition, it is still another object of the present invention to provide an electrophotographic photosensitive member comprising: a photoconductive layer comprising a non-single-crystal material containing silicon atoms as a matrix on a cylindrical substrate; a first surface layer comprising a non-single-crystal material; and a second surface layer comprising a non-single-crystal carbon containing at least fluorine, these layers being successively formed in this order, wherein hardness of the first surface layer is larger than that of the second surface layer and the center line average surface roughness (Ra) of the first surface layer is 50 Å to 5000 Å, and an electrophotographic apparatus having the above described photosensitive member.

DESCRIPTION OF THE PREFERRED EMBODIMENTS

Figure 1A:
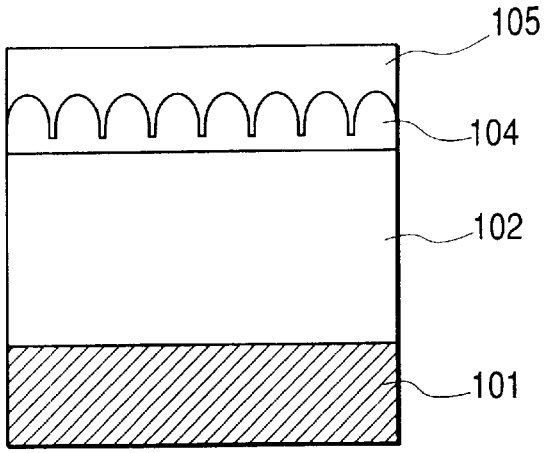
FIG. 1A, FIG. 1B, FIG. 1C, FIG. 2 and FIG. 3 respectively show schematic sectional views for explaining an embodiment of an electrophotographic photosensitive member.

The inventors of the present invention have confirmed that an electrophotographic photosensitive member according to the present invention had a water repellency on its surface more improved than that of a conventional electrophotographic photosensitive member using a non-single-crystal silicon carbide (a-SiC) film or a non-single-crystal carbon (a-C) film by employing a non-single-crystal carbon (a-C:F) film containing at least fluorine, an image dimness or an image smearing was not generated under an environment of high temperature and high humidity without providing the heating means of the photosensitive member, the sliding characteristic on the surface of the photosensitive member was extremely improved and the cleaning characteristic of an electrophotographic apparatus was enhanced.

However, the a-C:F film was relatively softer than the a-SiC film and the a-C film, and readily scraped in an electrophotographic process. Therefore, it was problematic to directly employ the a-C:F film as it was.

The inventors devoted themselves to study how the above described advantages of the a-C:F film were applied to the surface layer of the electrophotographic photosensitive member, hence they found that the water repellency of and the sliding characteristic of the surface could be-maintained even when the a-C:F film was scraped due to a repeated use by forming a surface layer with a two-layer configuration of a first surface layer and a second surface layer, controlling the center line average surface roughness (Ra) of the first surface layer to a range of 50 Å to 5000 Å on the basis of JIS B0601 and using the a-C:F film for the second surface layer.

The first surface layer of the present invention may comprise either an a-C film comprising carbon and an a-C:H film comprising carbon and hydrogen. In order to make the effects of the present invention more prominent, the a C:H film may be preferably employed.

Further, the first surface layer of the present invention may comprise an a-SiN:H film comprising silicon, hydrogen and nitrogen, an a-SiO:H film containing silicon, hydrogen and oxygen and an a-SiNO:H film containing silicon, hydrogen, nitrogen and oxygen. In this case, in order to make the effects of the present invention remarkable, the a-SiN:H film may be preferably used.

Particularly, as a material of the first surface layer, a hydrogenated non-single-crystal silicon nitride (a-SiN:H) or a hydrogenated non-single-crystal silicon nitride (a-SiO:H) is employed for the first surface layer, so that the surface roughness of a photoconductive layer serving as a substrate can be simply controlled, or does not need to be controlled. Further, a latitude for manufacture can be increased and the degree of freedom in designing a material can be increased.

Still further, the affinity between the first surface layer comprising a-SiN:H or a-SiO:H and the a-C:F film is extremely higher than the first surface layer comprising a-C:H. In this case, not only the film is hardly stripped from the surface, but also an electrical matching is high. Therefore, the peeling of the film resulting from the unevenness in manufacturing is not generated, nor an unexpected peeling of the film is generated for a long period. Besides, a charging performance is effectively improved, a residual potential is reduced and an optical memory is advantageously reduced. Accordingly, a latitude in designing the material of the a-C:F film can be widened.

Now, referring to the accompanying drawings, the present invention will be described in more detail.

Figure 1B:
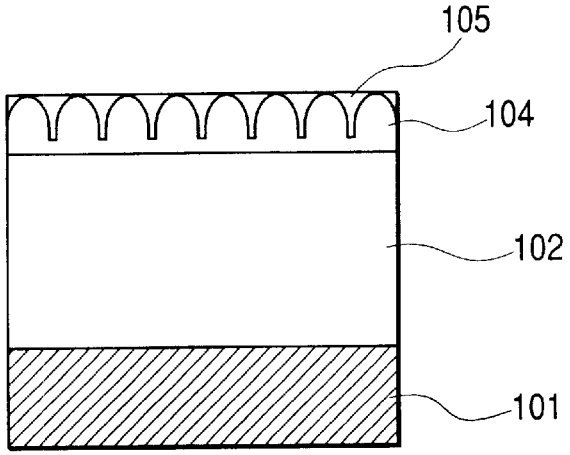
Figure 1C:
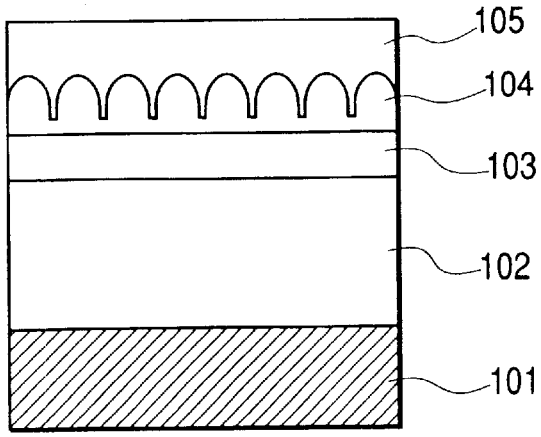

FIG. 1 schematically shows a section of an electrophotographic photosensitive member according to the present invention. In FIGS. 1A and 1B, a reference numeral 101 denotes a cylindrical substrate, 102 denotes a photoconductive layer, 104 denotes a first surface layer and 105 denotes a second surface layer. In FIG. 1C, 101 denotes a cylindrical substrate, 102 denotes a photoconductive layer, 103 denotes a buffer layer, 104 denotes a first surface layer and 105 denotes a second surface layer.

The buffer layer 103 can be provided in order to gain a material matching characteristic between the photoconductive layer 102 and the first surface layer 104. Thus, it is desired to have an intermediate material composition between them. Further, the composition of the photoconductive layer 102 to the composition of the first surface layer 104 may be changed partly or throughout all the layer of the buffer layer 103.

When the a-C film of the first surface layer is formed in the present invention, for instance, gas of $CH_4$, $C_2H_2$, $C_2H_4$, $C_2H_6$, $C_3H_8$, $C_4H_{10}$, etc. may be mixed with these gases and hydrogen gas or a dilution gas of helium or the like and the mixture may be decomposed.

Further, when the a-SiN:H film is employed for the first surface layer in the present invention, for instance, nitrogen supplying gas such as $N_2$, $NH_3$, NO, $NO_2$, etc. is mixed with silicon supplying gas of gaseous or gasified silicon hydride (silane) and the mixture is decomposed to produce the a-SiN:H film. These gases may be mixed with the dilution gas of hydrogen, helium, argon, etc. and the mixture may be decomposed.

When the a-SiO film is used for the first surface layer in the present invention, for instance, oxygen supplying gas such as $O_2$, NO, $NO_2$, $N_2O$, etc. may be mixed with silicon supplying gas of gaseous or gasified silicon hydride (silane) such as $SiH_4$, $Si_2H_6$, $Si_3H_8$, $Si_4H_{10}$, etc. and the mixture is decomposed to form the a-SiO:H film. Further, these gases may be mixed with the dilution gas of hydrogen, helium, argon or the like and the mixture may be decomposed.

According to the present invention, the surface roughness of the first surface layer is important.

In the present invention, the first surface layer is formed in such a manner that the center line average surface roughness (Ra) of the surface is located within a range of 50 Å to 5000 Å, preferably, within a range of 100 Å to 1000 Å on the basis of JIS B0601.

In order to locate the surface roughness within this range, various methods such as polishing, etching, the optimization of manufacturing conditions may be considered. If the a-SiN:H film or the a-SiO:H film is employed as the material of the first surface layer, the surface roughness can be located within the range of 50 Å to 5000 Å under extensive manufacturing conditions.

Therefore, it is not necessary to especially control the surface roughness of the photoconductive layer 102 to a specific range, or roughen the surface under a method such as polishing, etching, etc., so that a plant and equipment investment for production or labor, cost and tact time can be reduced.

Further, when the a-SiN:H or the a-SiO:H is used as the material of the first surface layer, it has an extremely good matching feature relative to the a-C:F used for the second surface layer. In accordance with this feature, a charging performance can be improved, a residual potential can be reduced and an optical memory can be effectively reduced. Thus, the latitude for designing the material of the a-C:F film can be enlarged.

FIG. 1B schematically shows a section of the electrophotographic photosensitive member after it is installed in the electrophotographic apparatus and employed for a long time. The second surface layer contains much fluorine, and has a high water repellency, however, is rather soft in view of hardness so that it may be possibly worn for a long period of use.

The schematic view of FIG. 1B shows a state after the second surface layer is worn. As can be understood from this schematic view, the second surface layer 105 laminated on the:first surface layer 104 is suitably superposed in the recessed parts of the first surface layer 105 and the second surface layer 105 remains in the recessed parts of the first surface layer even after the second surface layer 105 is scraped from the first surface layer during the electrophotographic process.

As a result of the investigation of the inventors of the present invention, it has been found that, when the center line average surface roughness (Ra) is located within the range of 50 Å to 5000 Å, preferably, within the range of 100 Å to 1000 Å on the basis of JIS B0601, the residual amount of the second surface becomes proper and an image smearing can be completely prevented.

The center line average surface roughness (Ra) of the first surface layer is made 50 Å or more, preferably 100 Å or more, hence, what is called, there is eliminated a fear that the second surface layer hardly remains in the recessed parts of the first surface layer because of an excessively smooth surface and the effects of the present invention can be obtained with ease.

Further, the center line average surface roughness (Ra) is 5000 Å or less, preferably 1000 Å or less, so that the second surface layer can be suitably left in the recessed parts of the first surface layer. In addition, after the second surface layer is cut or scraped from the surface in the electrophotographic process, such a phenomenon that the second surface layer partly remaining in the recessed parts can be further easily scraped or shaved from the surface can be prevented. Besides, such a bad influence as the influence of irregularities of the first surface layer applied to a cleaning process in the electrophotographic processes can be avoided.

Still further, according to the present invention, the hardness of the first surface layer is important in order to suppress the scraping or peeling of the surface after the second surface layer is scraped or cut in the electrophotographic processes and a part of the first surface layer is exposed. More specifically, dynamic hardness of the first surface layer is desirably located within a range of 300 to 1000 kgf/mm$^2$, preferably, within a range of 500 to 1000 kgf/mm$^2$, and more preferably within a range of 700 to 1000 kgf/mm$^2$.

The dynamic hardness in the present invention specified here is measured by a dynamic hardness tester (model number DUH-201) produced by Shimadzu Corporation. In this connection, when a sample was manufactured, 7059 glass (produced by Corning company) set on a cylindrical aluminium substrate was employed.

The dynamic hardness of the first surface layer is set to 300 kgf/mm$^2$ or higher, or preferably to 500 kgf/mm$^2$ or higher, and more preferably to 700 kgf/mm$^2$ or higher, so that the generation of vein shaped uneven cuts formed in the course of use for a long time can be prevented, and bad effects such as the generation of a partial image smearing or the like owing to use for a long time, can be prevented, after the disappearance of the partial residual part of the second surface layer. Additionally, the dynamic hardness of the first surface layer is set to 1000 kgf/mm$^2$ or lower, so that not only the generation of uneven cuts of a film can be prevented, but also the fusion of the toner generated depending on environmental conditions can be avoided.

Therefore, it is desired to locate the values of the dynamic hardness within the above described range. In the case where the dynamic hardness is located within this range, even if the second surface is peeled or scraped off so that the protrusions of the first surface layer are exposed, the exposed parts are hardly worn during the electrophotographic processes, and accordingly, a performance is not deteriorated thereby.

What the exposed parts of the first surface layer are seldom worn to have no deterioration of a performance caused thereby means an abrasion loss or less in which the center line average surface roughness (Ra) of the first surface layer during the assumed life of the electrophotographic photosensitive member holds values located within the range of 50 Å to 5000 Å, preferably within the range of 100 Å to 1000 Å. The first surface layer which satisfies the above mentioned condition can satisfactorily exhibit the effects of the present invention.

In the present invention, when the a-C:H film is used for the first surface layer, the content of hydrogen atoms contained in the film is desirably 10 to 60% of H/(C+H) (atomic ratio), preferably 40 to 55%.

The content of hydrogens is set to 10 atomic % or higher, preferably to 40% or higher, so that fears, can be prevented, that an optical gap band is narrowed and the film is not suitable in view of sensitivity. Further, the content of hydrogen atoms is set to 60% or lower, preferably to 55% or lower, so that a fear that the hardness is lowered and the peeling of the film is liable to be generated can be prevented.

Generally, the optical band gap having values of 1.2 eV to 2.8 eV or so can be preferably employed and the values of 1.6 eV or higher are more desirable in view of sensitivity. Refractive index of about 1.5 to 2.8 may be preferably used. The refractive index of 1.6 to 2.4 or so may be more preferable.

The thickness of a film ranges from 50 Å to 10000 Å, and preferably located within a range of 100 Å to 2000 Å. The thickness of the film of 50 Å or larger can provide a sufficient mechanical strength. The thickness of the film of 10000 Å or lower generates no problem from the viewpoint of photosensitivity.

Further, in the present invention, when the a-SiN:H film is employed for the first surface layer, the content of hydrogen atoms contained in the film is desirably 10 to 50% of H/(Si+N+H)(atomic ratio), preferably 20 to 40%.

The content of hydrogen is set to 10 atomic % or higher, preferably to 20% or higher, so that fears, can be prevented, that an optical band gap is narrowed and the s-SiN:H film is not appropriate in view of photosensitivity. Further, the content of hydrogen is set to 50 atomic % or lower, preferably to 40% or lower, so that a fear that the hardness is lowered and the film is apt to be peeled or scraped off can be prevented.

Generally, the optical band gap having values of 2.0 eV to 2.8 eV or so can be preferably employed and the optical band gap of 2.4 eV or higher is more desirably used in view of sensitivity. Refractive index of 1.8 to 2.8 or so is preferably used. The refractive index of 2.0 to 2.4 is more preferable.

The thickness of a film ranges from 50 Å to 10000 Å, preferably from 100 Å to 5000 Å. The thickness of the film of 50 Å or larger provides a sufficient mechanical strength. The thickness of the film of 10000Å or smaller generates no problem in view of the photosensitivity.

When the a-SiO:H film is employed for the first surface layer, the thickness of the film or the like may be taken into account similarly to the case in which the a-SiN:H film is used for the first surface layer.

In any case, it is eagerly desired to have values in a dynamic hardness test located within the range of 300 to 1000 kgf/mm$^2$, preferably within the range of 500 to 1000 kgf/mm$^2$ and more preferably within the range of 700 to 1000 kgf/mm$^2$ from the viewpoints of hardness and lubricating ability.

In the present invention, the second surface layer comprises the a-C:F film formed by decomposing feed gas containing carbon atoms and fluorine atoms. As the feed gas, for instance, the gas containing carbon atoms, there are enumerated, $CH_4$, $C_2H_2$, $C_2H_4$, $C_2H_6$, $C_3H_8$, $C_4H_{10}$, etc.

As the gas containing fluorine atoms, is preferably employed the gas including fluorine such as $CF_4$, $C_2F_6$, $CHF_3$, $ClF_3$, $CHClF_2$, $F_2$, $C_3F_8$, $C_4F_{10}$, etc. When the a-C:F film is formed, a plasma CVD method is typically used. When the gas containing fluorine which contains carbon atoms such as $CF_4$, $C_2F_6$, etc. is used, the film may be formed by independently using these gases. However, the hydrogen gas or the dilution gas of helium or the like may be mixed with the gas including carbons such as $CH_4$, $C_2H_2$, $C_2H_4$, $C_2H_6$, $C_3H_8$, $C_4H_{10}$, etc. and the mixture may be decomposed.

In the present invention, the hardness of the second surface layer is also important, because the second surface layer prevents a fusion in the electrophotographic processes and is suitably left in the recessed parts of the first surface layer even after the second surface layer is scraped off due to its use for a long time. Specifically, the dynamic hardness of the second surface layer is desirably located within the range of 10 to 500 kgf/mm$^2$, preferably within the range of 50 to 450 kgf/mm$^2$ and more preferably within the range of 100 to 400 kgf/mm$^2$.

The dynamic hardness of the second surface layer is set to 10 kgf/mm$^2$ or higher, preferably to 50 kgf/mm$^2$ or higher and more preferably to 100 kgf/mm$^2$ or higher, so that a trouble, can be prevented, that the second surface layer is worn in the course of use and the second surface layer remaining in the protrusions and recessed parts of the first surface layer is also scraped off. Therefore, the effects can be more realized.

Further, the dynamic hardness of the second surface layer is 500 kgf/mm$^2$ or lower, preferably 450 kgf/mm$^2$ or lower and more preferably 400 kgf/mm$^2$ or lower, so that not only a trouble such as the peeling or scraping of the film can be prevented, but also the fusion of toner generated under environmental conditions can be avoided. Therefore, it is desired to locate the values of the dynamic hardness of the second surface layer within the above described ranges.

Still further, the dynamic hardness of the second surface layer is preferably smaller than that of the first surface layer. Furthermore, the dynamic hardness of the first surface layer is preferably larger by 50 kgf/mm$^2$ or more than that of the second surface layer or is preferably 1.5 times as high as the dynamic hardness of the second surface layer.

Consequently, the second surface layer is prevented from being scraped off due to the recession of the first surface layer exposed after the second surface layer is worn, owing to its abrasion on the periphery of the still remaining second surface layer.

The dynamic hardness of the second surface layer is located within the above described ranges, so that the second surface layer is gradually scraped off during the electrophotographic processes, however, it does not completely disappear but continuously exists substantially on the uppermost surface. The abrasion loss means the amount of peeling or scraping of the film obtained when 1000 sheets of A4 size for a transverse feed are copied. The amount of scraping of the second surface layer is set to within a range of 0.1 Å to 100 Å, so that the effects of the present invention can be more achieved.

In the present invention, the content of fluorine atoms contained in the film of the second surface layer is desirably 6 to 50% of F/(C+F)(atomic ratio), preferably 30 to 50%.

When the content of fluorine is set to a value lower than 6%, the water repellency of the surface of the second surface layer may be sometimes lowered. Further, when the content of fluorine exceeds 50%, the hardness is may be lowered and, as a result, the generation of the vein shaped cuts of the film of the second surface layer may occur. In other words, the content of fluorine contained in the film of the second surface layer is located within the above described ranges, so that the deterioration of water repellency of the surface can be prevented, and the decrease of the hardness and-the generation of the vein shaped cuts of the film can be prevented.

Generally, an optical band gap of values of 1.2 eV to 2.8 eV or so can be preferably employed and the optical band gap of 1.6 eV or higher is more desirable in view of photosensitivity. Refractive index of about 1.8 to 2.8 is preferably used.

The thickness of the film ranges from 50 Å to 1000 Å, preferably from 100 Å to 2000 Å. The thickness of the film of the second surface layer is 50 Å or larger, so that the film of the second surface layer can sufficiently enter and remain in the recessed parts of the first surface layer as described above, and the effects of the present invention can be satisfactorily obtained. If the thickness of the film is 10000 Å or lower, there will be generated no problem in view of the photosensitivity.

The electrophotographic photosensitive member according to the present invention can be formed by an ordinary plasma CVD method. Generally, since the plasma CVD method greatly depends on an apparatus, cannot be uniformly specified conditions for forming the a-C:H film, the a-SiN:H film and the a-SiO:H film of the first surface layer or the a-C:F film of the second surface layer according to the present invention. However, the characteristics of a formed deposited film usually greatly change by carrying out the adjustment of kinds of feed gas, kinds of carrier gas, a gas mixing method, a gas introducing method and an exhaust configuration, a pressure adjustment, a power adjustment, a frequency adjustment, the adjustment of a power wave form, the adjustment of a DC bias, the adjustment of substrate temperature, the adjustment of film forming time, or the like.

Accordingly, the surface roughness of the first surface layer and the forced hardness in the dynamic hardness test under specific conditions according to the present invention can be controlled by suitably adjusting these parameters.

As a result of the study of the inventors of the present invention, it has been found that the feed gas was decomposed by a plasma CVD method especially using the high frequency of 1 to 450 MHZ so that the first surface layer of the present invention could be easily produced.

In particular, it is recognized from an experiment that there is possibly a correlation between the frequency and the surface roughness of the first surface layer. When the frequency is lower than 1 MHZ, the surface of the first surface layer becomes too smooth depending on conditions and the above described effects may not be obtained. Further, when the frequency is higher than 450 MHZ, the degree of irregularity on the surface is increased depending on the conditions, hence the center line average surface roughness (Ra) may be possibly larger than 5000 Å.

At present, it is not clear which mechanism acts on the relation between the frequency for decomposing the feed gas and-the surface roughness and as to whether or not the high frequency of 1 to 450 MHZ is suitable for the range of the surface roughness of the present invention, however, it can be assumed that an energy generated from the high frequency and the difference in the; growth process of the deposited film due to the difference in surface reaction are related thereto.

If the high frequency power is increased as high as possible, the-decomposition of hydrocarbon will be sufficiently promoted. Therefore, the high frequency power of 5 W/cc or higher is specifically preferable for the feed gas of hydrocarbon. However, when the high frequency power is too high, an abnormal discharge may be generated, so that the characteristic of the electrophotographic photosensitive member may be possibly degraded. Accordingly, it is necessary to suppress the power so that the abnormal discharge is not generated.

As for the pressure of a discharge space, when an ordinary RF (typically, 13.56 MHZ) power is employed, the pressure is maintained in 10 Pa to 1000 Pa. When a VHF band (typically, 50 to 450 MHZ) is employed, the pressure is maintained approximately in 0.01 Pa to 10 Pa.

Further, the substrate temperature can be adjusted to 350° C. from room temperature. However, when the substrate temperature is too high, a band gap is decreased to lower a transparency. Therefore, the substrate temperature is desirably set to a lower temperature, preferably to 100° C. to 300° C.

According to a method for producing the photoconductive layer 102 of the present invention, a non-single-crystal film composed of silicon atoms as a matrix, for instance, an amorphous silicon film which is an optimum material, an organic photosensitive member, a Se photosensitive member, a CdS photosensitive member or the like may be preferably employed. As conditions for forming the photoconductive layer composed of a non-single-crystal material containing silicon atoms as a matrix, when the plasma CVD method is utilized, the high frequency is not specially limited, or a glow discharge plasma with a microwave can be preferably used. Thus, the photo-conductive layer 102 can be manufactured by decomposing the feed gas including the silicon atoms in accordance with the glow discharge plasma.

However, as the conditions for forming the photoconductive layer composed of the non-single-crystal material containing silicon atoms as a matrix, it is desired to adopt a method similar to the methods for producing the first surface layer and the second surface layer from the viewpoint of simplicity of manufacturing processes. The plasma CVD method is especially desirable.

In the schematic view shown in FIG. 1, the photoconductive layer is composed of a single layer in which functions are not separated from one another and made of an amorphous material including at least silicon atoms and exhibits a photoconductivity.

Figure 2:
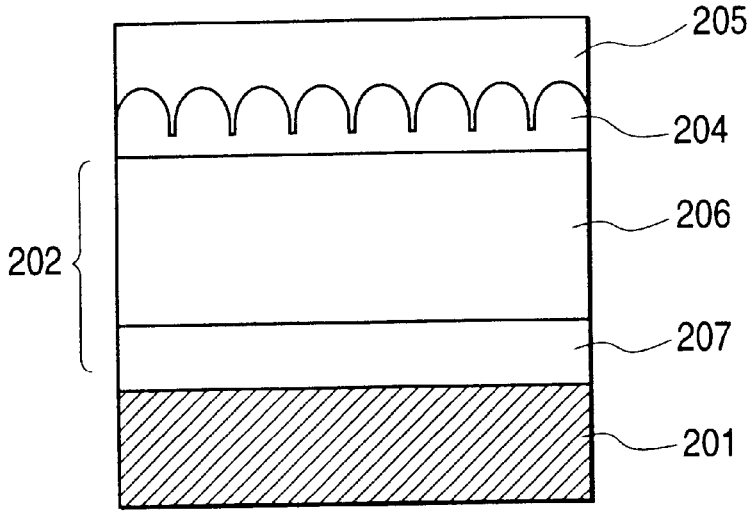

Further, as shown in FIG. 2, a photoconductive layer 202 may be,divided into two layers comprising a layer 206 composed of an amorphous material containing at least silicon atoms and showing a photoconductivity and a lower blocking layer 207 for blocking the injection of a carrier from a substrate 201.

Figure 3:
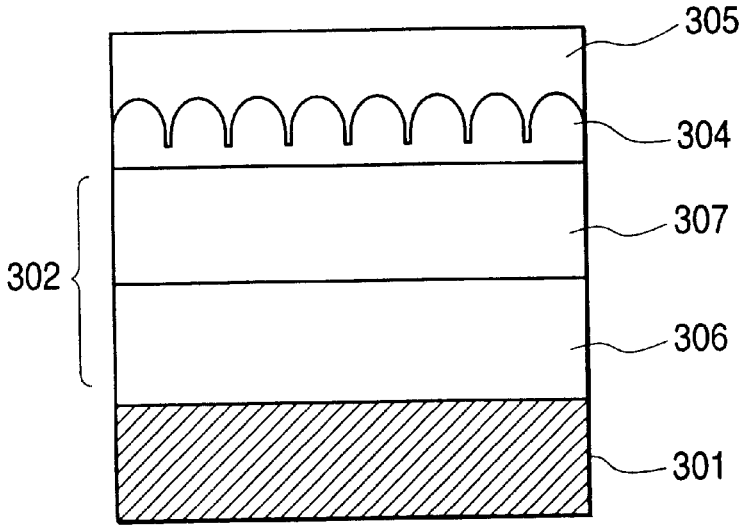

Still further, as shown in FIG. 3, a photoconductive layer 302 may be formed in a function separate type comprising a charge transport layer 306 composed of an amorphous material containing at least silicon atoms and carbon atoms and a charge generating layer 307 composed of an amorphous material containing at least silicon atoms, these layers being successively laminated. When the electrophotographic photosensitive member is irradiated with light, the carrier produced mainly in the charge generating layer 307 is supplied to a conductive substrate 301 through the charge transport layer 306.

The thickness of the film of the photoconductive layer is 1 μm to 100 μm, preferably 1 μm to 50 μm. However, the thickness of the film may be properly set on the basis of a charging capacity and a sensitivity demanded by a copying machine body. Generally, it is desired that the thickness of the film is 10 μm or higher in view of sensitivity and is 50 μm or lower from the viewpoint of the industrial productivity.

Now, an example of a method for forming the electrophotographic photosensitive member of the present invention will be below described in detail.

Figure 4:
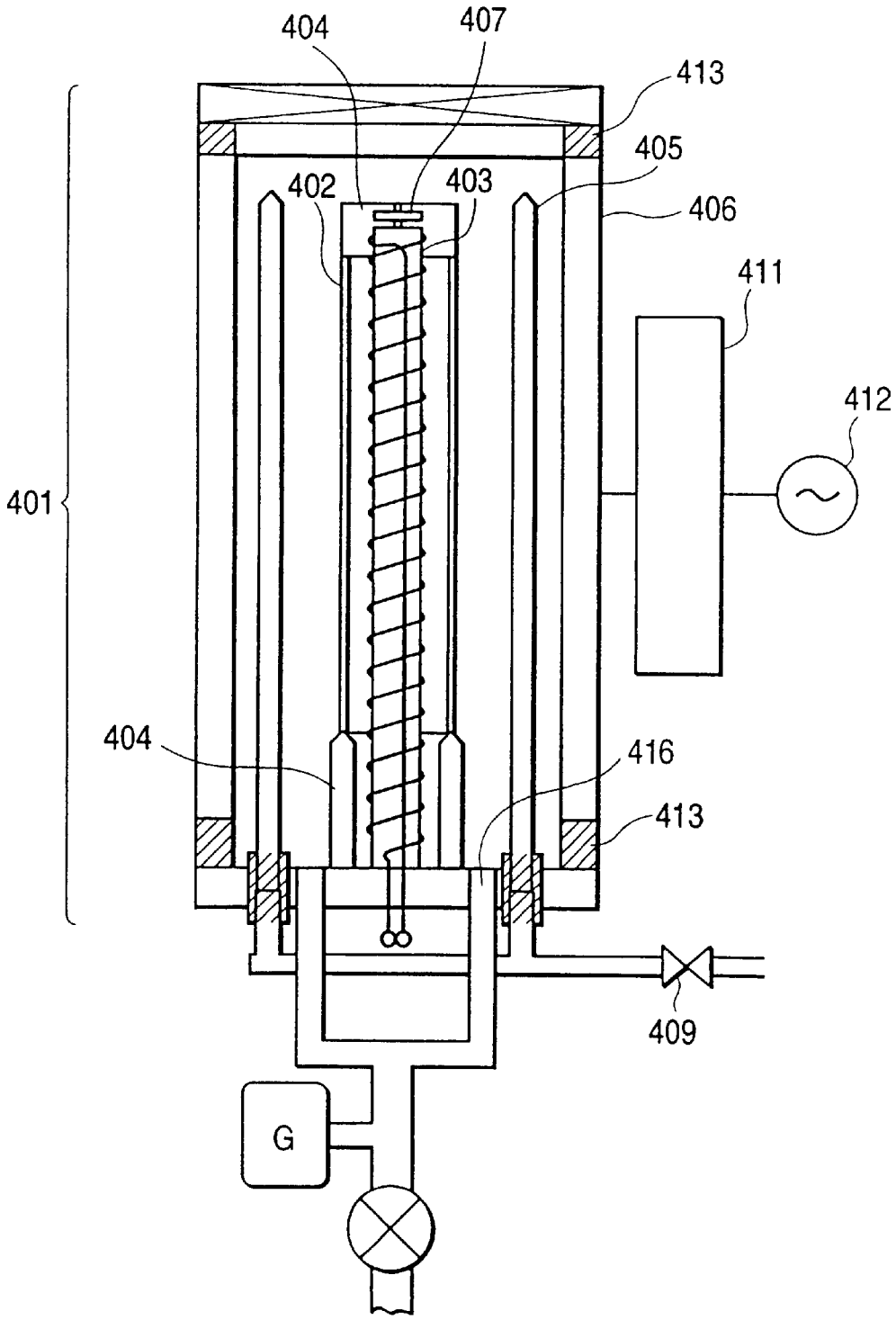
FIG. 4 and FIG. 5 respectively show schematic sectional views for explaining an embodiment of a deposited film forming apparatus.

FIG. 4 is a. view schematically showing an example of a deposition system based on a plasma CVD method using the high frequency power supply of 13.56 MHz which is employed for manufacturing the electrophotographic photosensitive member according to the present invention.

The system is roughly composed of a deposition device and an exhaust device (not shown) for reducing the pressure of a reaction vessel. In the reaction vessel 401, a cylindrical substrate 402 is disposed on a conductive receiving base 407 connected to an earth, and the heater 403 of the cylindrical substrate and a feed gas introducing pipe 405 are further provided therein.

A cathode electrode 406 is made of a conductive material and insulated by an insulating material 413. The cathode electrode is connected to the high frequency power source 412 of 13.56 MHZ through a high frequency matching box 411.

A cylinder of each composite gas of a feed gas supply device (not shown) is connected to the gas introducing pipe 405 in the reaction vessel 401 through a valve 409.

The substrate 402 whose surface is subjected to a specular work by using, for instance, a lathe is attached to an auxiliary substrate 404 so as to include the substrate heating heater 403 in the reaction vessel 401.

Then, the feed gas introducing valve 409 is closed to temporarily exhaust gas in the reaction vessel 401 by the exhaust device through an exhaust port 416. After that, the feed gas introducing valve 409 is opened to introduce inactive gas for heating such as argon gas to the reaction vessel 401 from the gas supply pipe 405. Thus, the exhaust speed of the exhaust device and the flow rate of the heating gas are adjusted so as to have a desired pressure in the reaction vessel 401.

Subsequently, a temperature controller (not shown) is operated to heat the substrate 402 by the substrate heating heater 403. Thus, the temperature of the cylindrical substrate 402 is controlled to a desired temperature located within a range of 20° C. to 500° C. When the substrate 402 is heated to the desired temperature, the feed gas introducing valve 409 is closed to stop the entry of the gas to the reaction vessel 401.

For forming the deposited film, the feed gas introducing valve 409 is opened and prescribed feed gas, for instance, material gas such as silane gas, disilane gas, methane gas, ethane gas, etc. are mixed with doping gas such as diborane gas, phosphine gas, etc. by a mixing panel (not shown), and then the mixture gas is introduced to the reaction vessel 401. Then, each feed gas is adjusted so as to have a prescribed flow rate by a mass flow controller (not shown).

After a preparation for forming the film is completed in accordance with the above described procedure, the photoconductive layer is formed on the cylindrical substrate 402. After it is recognized that the internal pressure is stabilized, the high frequency power source 412 is set to a desired electric power to supply the high frequency power to the cathode electrode 406 through the matching box 411 and induce a high frequency glow discharge.

Each feed gas introduced to the reaction vessel 401 is decomposed by this discharge energy so that a prescribed deposited film is formed on the cylindrical substrate 402. After the film having a desired thickness is formed, the supply of the high frequency power is stopped, the entry of each feed gas to the reaction vessel 401 is stopped and the vacuum state of a deposition chamber is raised to a high level to completely form the layer. The above mentioned operations are repeated to form, for instance, the lower blocking layer and the photoconductive layer.

Then, the first surface layer of the present invention is formed. After the photoconductive layer with the desired film thickness is formed in accordance with the above described procedure, the discharge is temporarily stopped, and the gas of the reaction vessel 410 is exhausted. After that, when, for instance, the a-C:H film is formed, the feed gas such as $CH_4$, $C_2H_2$, $C_2H_4$, $C_2H_6$, $C_3H_8$, $C_4H_{10}$, etc. is occasionally mixed with hydrogen gas or the dilution gas of helium, etc. and the prescribed flow rate of the mixture is introduced to the reaction vessel 401 from the feed gas introducing pipe 405 through the valve 409.

Further, when, for instance, the a-SiN:H film is formed, the feed gas such as silane gas including $SiH_4$, $Si_2H_6$, $Si_3H_8$, etc., gas containing nitrogen such as $N_2$. $NH_3$, NO, etc. and occasionally, hydrogen gas or the dilution gas of helium, etc. are mixed together, and the prescribed flow rate of the mixture gas is introduced to the reaction vessel 401 from the feed gas introducing pipe 405 through the valve 409.

Subsequently, the film is formed in accordance with a procedure similar to the above described procedure for forming the photoconductive layer. Also when the a-C:F film of the second surface layer is formed, it is formed in accordance with the same except use of the above described gas including nitrogen.

Figure 5:
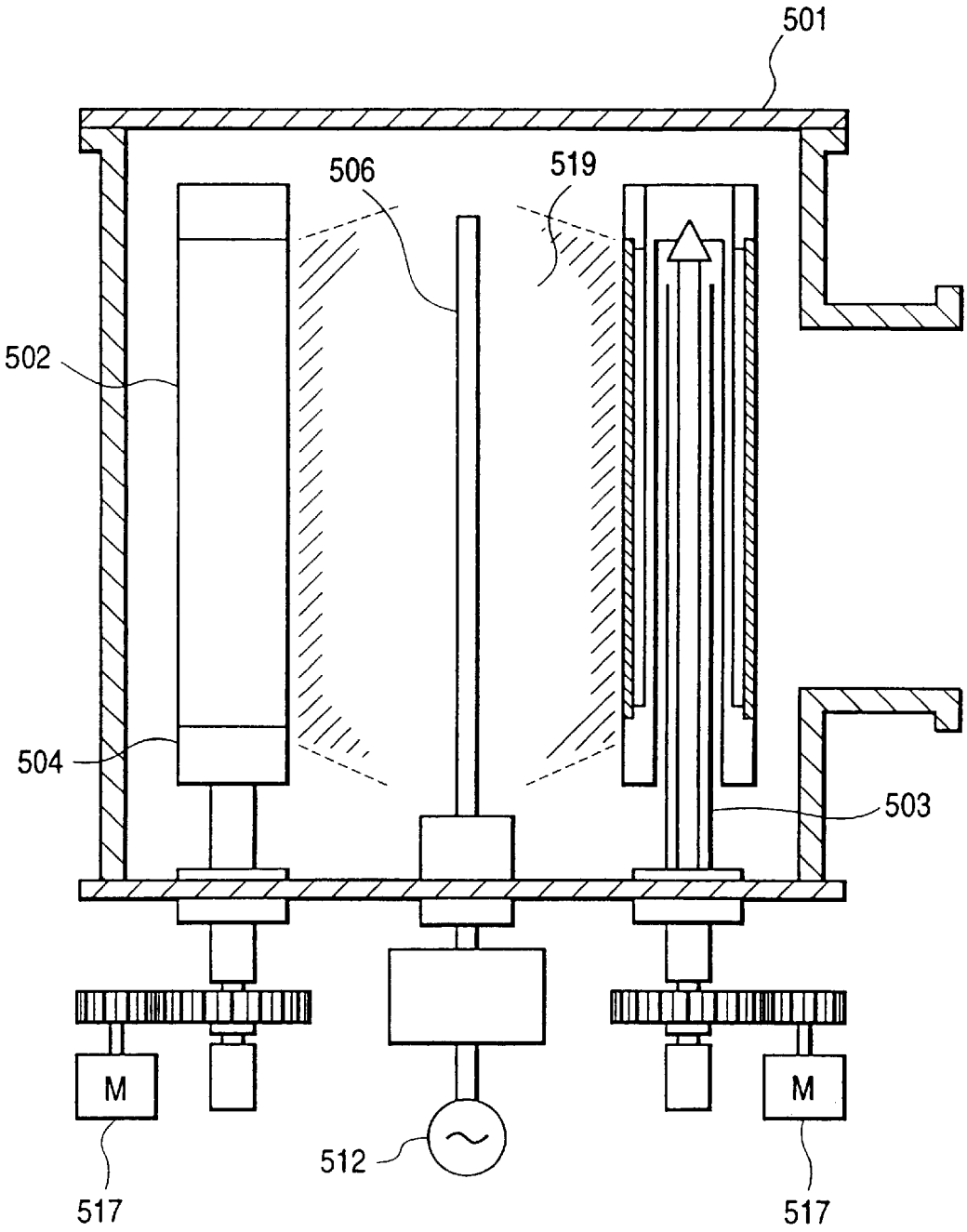

FIG. 5 is a schematic view of another plasma CVD system for embodying the present invention. In the system shown in FIG. 5, a cylindrical substrate 502 is concentrically arranged in a reaction vessel 501 with a cathode electrode 506 provided at its center and a discharge space 519 is formed with a space surrounded thereby. The cylindrical substrate 502 is driven to rotate by a rotary motor 517 so that a film is formed on all the circumference thereof. A high frequency power source 512 in this device is so designed as to change frequency to an arbitrary value.

After the cylindrical substrate 502 is previously heated to a prescribed temperature by a heater 503 in a similar manner to that of the system shown in FIG. 4, the deposited film composed of respective layers is formed in the same procedure, so that a desired electrophotographic photosensitive member can be obtained.

Figure 6:
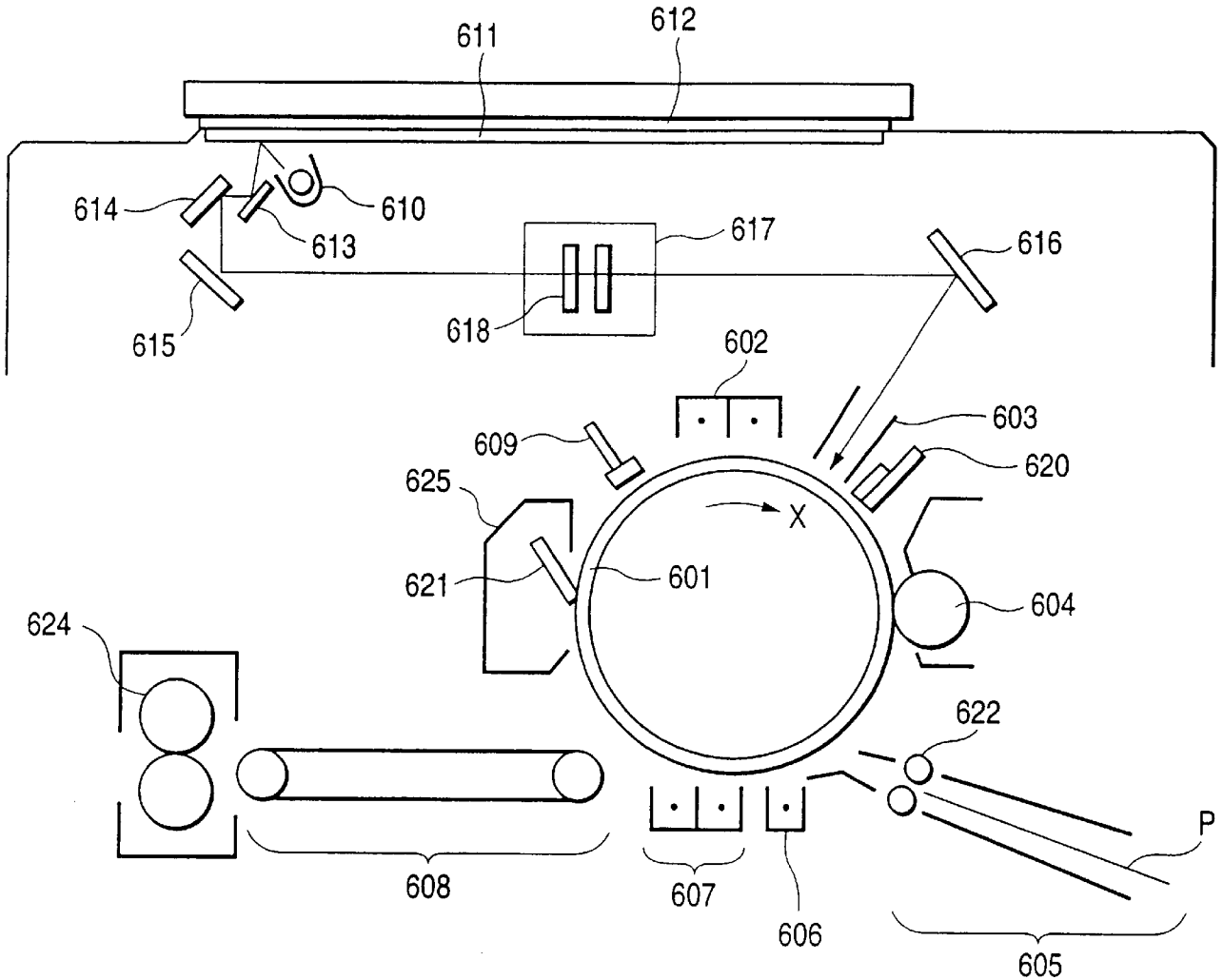
FIG. 6 is a schematic sectional view for explaining an embodiment of an electrophotographic apparatus.

FIG. 6 is a schematic sectional view for explaining an embodiment of an electrophotographic apparatus. A light receiving member 601 rotates in the direction shown by an arrow mark X as desired. In the periphery of the light receiving member 601, are arranged as required a main charger 602, an electrostatic latent image forming part 603, a developing device 604, a transfer material supply system 605, a transfer charger 606, a separate charger 607, a cleaner 625, a conveying system 608, a discharge light source 609, etc.

Now, an example of an image forming process will be specifically described below. The light receiving member 601 is uniformly charged or electrified by the main charger 602 to which the high voltage of +6 to 8 kV. Thus, light emitted from a lamp 610 is reflected on an original for copying 612 placed on an original for copying base glass 611 and the reflected light passes through mirrors 613, 614 and 615, so that an image is formed by the lens 618 of a lens unit 617. Then, the image is guided via a mirror 616 and projected on the electrostatic latent image part as the light carrying information so that an electrostatic latent image is formed on the light receiving member 601. A developer with a negative polarity is supplied to the latent image from the developing device 604 to form a developer image. An exposure may not depend on the reflection from the original 612 but may be carried out by applying scanning and exposing processes to the light carrying the information by the use of an LED or a laser beam, or a liquid crystal shutter.

On the other hand, a transfer material P such as a paper sheet passes through the transfer supply system 605 and a leading end supply timing is adjusted by a resist roller 622. Then, the transfer material P is supplied toward the light receiving member 601. To the transfer material P, is applied the positive electric field of a polarity reverse to that of the developer from a rear surface in the clearance between the transfer charger 606 to which the high voltage of +7 to 8 kV is applied and the light receiving member 601, so that the developer image with the negative polarity on the surface of the light receiving member is transferred to the transfer material P. Then, the transfer material P is separated from the light receiving member 601 by the separate charger 607 to which the high AC voltage of 12 to 14 kVp-p, 300 to 600 Hz. After that, the transfer material P passes through the transfer conveying system 608 and reach the fixing device 624 to fix the developer image thereon, and is discharged from the device.

The developer remaining on the light receiving member 601 is recovered by a cleaning blade 621 made of an elastic material such as silicone rubber or urethane rubber of the cleaner 625. The remaining electrostatic latent image is erased by the discharge light source 609.

A blank exposure LED 620 is provided to expose the light receiving member 601 as required so that an unnecessary developer adheres to a part of the light receiving member 601 exceeding the width of the transfer material P and a non-image forming area such as a blank part.

Now, the present invention will be described in more detail by way of embodiments, however, it should be noted that the present invention is not limited to these embodiments.

EXAMPLE 1

A charge injection blocking layer and a photoconductive layer were successively laminated on a cylindrical A1 substrate under conditions shown in Table 1 by employing the plasma CVD system shown in FIG. 4. A procedure for forming a film was based on the above described procedure. Subsequently, first surface layers 1A to 1E composed of the a-C:H film were laminated under conditions shown in Table 2, and further, a second surface layer was laminated on the respective first surface layers under conditions shown in Table 3 to obtain a total of five electrophotographic photosensitive members.

Further, five electrophotographic photosensitive members for measuring the surface roughness which were formed from substrates to first surface layers were formed at the same time in accordance with the same procedure. The dynamic hardness of the second surface layer measured in accordance with a method described below was 125 kgf/mm$^2$.

COMPARATIVE EXAMPLE 1

By using the plasma CVD system shown in FIG. 4, a charge injection blocking layer and a photoconductive layer were successively laminated on a cylindrical A1 substrate under the same conditions as those of Example 1. Subsequently, a surface layer made of the a-SiC:H film was laminated thereon under conditions shown in Table 4 to produce an electrophotographic photosensitive member.

The electrophotographic photosensitive member thus produced was evaluated as mentioned below.

Image Smearing:

The electrophotographic photosensitive member was installed on an acceleration tester in which the quality of a material and pushing pressure of the cleaning blade of the electrophotographic apparatus (NP 6060 produced by Canon Inc.) were modified and 20000 sheets of test charts (parts No: FY 919058) produced by Canon Inc. were copied under an environment of high temperature of 32° C./high humidity of 80% without heating a drum. Then, a copying machine was temporarily stopped. Under this state, the temperature was changed to 35° C. and the humidity was changed to 90% and the copying machine was left as it was for 5 hours.

After that, the copying operation of the above described 20000 sheets of test charts and the stopping operation of the copying machine for 5 hours were repeated to obtain a total of 100000 sheets with durability.

An image smearing was decided by discriminating the outlines of the characters of images thus obtained and it was decided on which sheet of all the sheets the image smearing of the copied images was recovered after stop of five hours.

Measurement of Film Thickness of Surface Layer After Endurance:

The electrophotographic photosensitive member carrying out the above described endurance was taken out from the copying machine and the film thickness of the second surface layer was calculated by using a spectral reflection meter (CL-3000R produced by Otsuka Electronics Co., Ltd.).

Measurement of Contact Angle of Surface After Endurance:

Water droplet was placed on the surface of the electrophotographic photosensitive member carrying out the above described endurance to measure the contact angle between the drum and the water droplet and compare it with the value before endurance.

Evaluation of Fusion of Toner:

The pushing pressure of the cleaning blade of the electrophotographic apparatus (NP6060 produced by Canon Inc.) was set to ⅓ times as high as the previous pressure and the surface temperature of the drum was set to 60° C., so that an environment in which the fusion is apt to be generated was created. The drum subjected to the endurance of 100000 sheets was installed on the acceleration tester modified as described above and the endurance of 100000 was carried out by employing original of 1% (an original for copying on which only a straight line is drawn in the diagonal direction of a sheet of A4 size). After the endurance, a halftone image was copied to examine the presence or absence of fusion. Specifically, in the halftone image on the sheet of A4 size, an area parallel to the direction of the bus line of the drum was prepared, the number of black points due to the fusion of the toner existing in the area was estimated and the results of five copied samples were obtained. The obtained results are decided on the basis of the values relative to the values acquired from the similar test for the surface layer (the drum formed in the Comparative Example 1) in the Comparative Example. Assuming that the value of the drum formed in the Comparative Example 1 is 50, the obtained results were evaluated on the basis of the number of points ranging from 1 to 100. When the number of points is smaller than 50, this denotes that the fusion is less than the surface layer of the Comparative Example. When the number of points is larger than 50, this denotes that the obtained surface layer is worse in its quality than the surface layer of the Comparative Example.

Measurement of Surface Roughness:

The electrophotographic photosensitive member for measuring the surface roughness which was formed with layers including from the substrate to the first surface layer was cut about 2 cm square, and the surface thereof was observed by an atmospheric probe microscope (Qscope Model 250 produced by Quesant Co., Ltd.). Data thus gained was analyzed to obtain a center line average surface roughness (Ra) on the basis of JIS B0601, said JIS B0601 standard being incorporated by reference.

Briefly stated, the center line average surface roughness (Ra) is a roughness obtained by an amplitude agverage in a prescribed section (area).

Definitions and Designation of Surface Roughness

1. Scope

This Japanese Industrial Standard specifies the definitions and designation of the center-line mean roughness ($R_a$), maximum height ($R_{max}$) and tenpoint mean roughness ($R_z$) expressing the surface roughness of industrial products.

Informative Reference

Although three kinds of designations given above are specified in this standard, it is preferable to use the designation by the center-line mean roughness in our country, because the applicational frequency of designation by the center-line mean roughness is high internationally.

2. Definitions

For the purpose of this standard, the following principal definitions apply:

(1) surface roughness Each arithmetic mean value of $R_a$, $R_{max}$ or $R_z$ at several parts sampled randomly from the surface of an object, hereinafter referred to as the "objective surface".

Remarks 1. Generally in an objective surface, surface roughnesses on individual positions are not uniform, and usually present considerably large dispersion. Therefore, in assessing the surface roughness of the objective surface, it is necessary to determine the measuring positions and numbers thereof so that the population mean can be assumed effectively.

2. According to the objects of measurement, an assessed value at one point on the objective surface may represent the surface roughness of the entire surface.

(2) profile A contour appears on a cut end, when a surface to be measured has been cut with a plane which is perpendicular to that surface.

Remark: In this cutting, unless otherwise specified, it shall be cut in a direction so that the surface roughness appears in the maximum magnitude. For example, in a surface to be measured having lay, it shall be cut in perpendicular to that direction.

(3) reference length of profile A length of a part sampled from the profile in a fixed length, hereinafter referred to as the "reference length".

(4) roughness curve and cut-off value A curve which has been cut off any longer surface waviness component than a prescribed wave length from the profile is defined as the roughness curve, and this prescribed wave length is defined as the cut-off value.

(5) mean line of profile or roughness curve A straight line or a curve having a geometrical feature of a surface to be measured within a sampled part of the profile or roughness curve, as well as so established that the sum of the squares of the deviations of the profile or roughness curve from that line is minimum.

(6) center-line of roughness curve A straight line which has been drawn in parallel with the mean line of the roughness curve so that the sums of the areas contained between it and the roughness curve which lie on each side of it are equal, hereinafter referred to as the "center-line".

Figure 7:
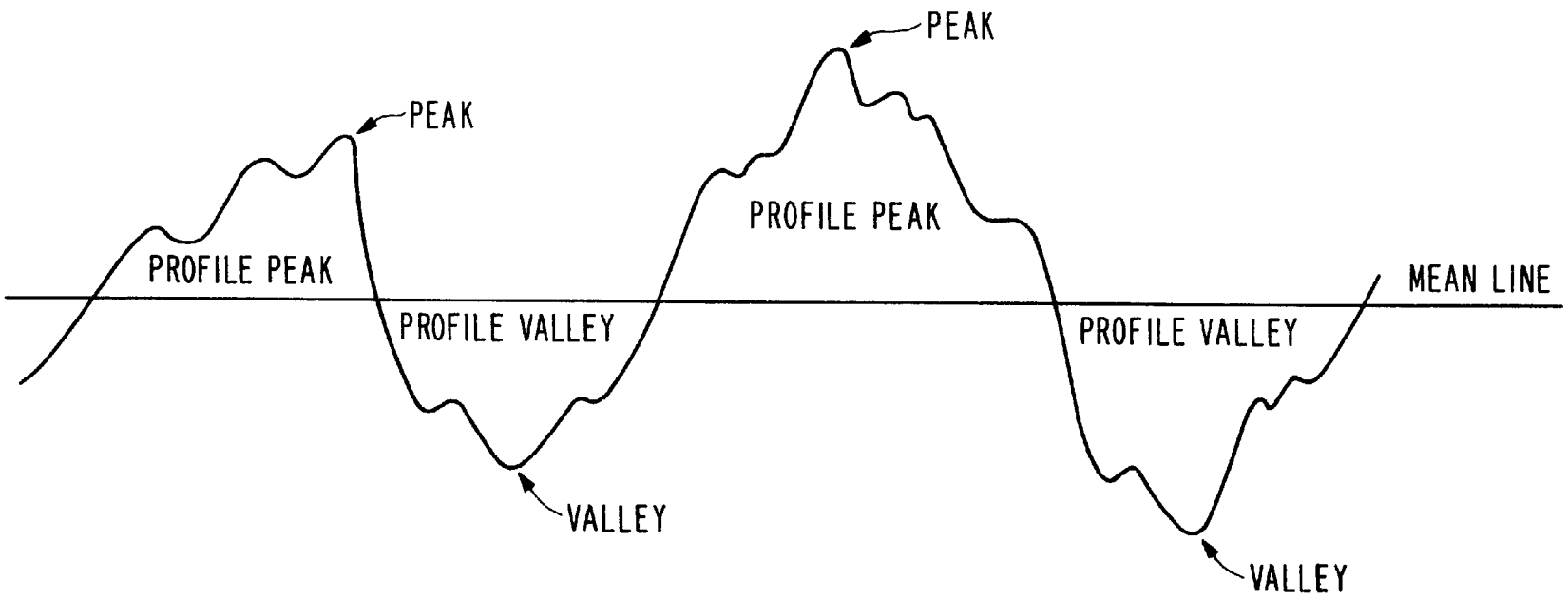
FIG. 7 PRIOR ART
FIG. 7 is curve in the Prior Art depicting a profile of a cut surface illustrating profile peaks, profile valleys and peaks and valleys.

(7) profile peak When a profile has been cut with the mean line, the protruding part of a real surface above the mean line, within the profile connecting two adjacent points of the intersection thereof (see FIG. 7).

(8) profile valley When a profile has been cut with the mean line, the sunken parts of a real surface below the mean line, within the profile connecting two adjacent points of the intersection thereof (see FIG. 7).

(9) peak A point of the highest altitude in the profile peak (see FIG. 7).

(10) valley A point of the lowest altitude in a profile valley (see FIG. 7).

3. Definitions and Designation

3.1 Definition of Center-line Mean Roughness ($R_a$)

3.1.1 Determination of Center-line Mean Roughness The Center-line mean roughness, when the roughness curve has been expressed by y=f(x), shall be a value, being expressed in micrometer ($\mu$m), that is obtained from the following formula, extracting a part of measuring length l in the direction of its center-line from the roughness curve, and taking the center-line of this extracted part as X-axis and the direction of vertical magnification as Y-axis.

$$R_a = \frac{1}{l}\int_0^l |f(x)|\,dx$$

3.1.2 Cut-off Value of Roughness Curve The cut-off value of the roughness curve, when a high-pass filter of −12 dB/oct in attenuation factor has been used in obtaining the roughness curve, shall be the wave length corresponding to the frequency attaining a gain of 75%, hereinafter referred to as the "cut-off value".

3.1.3 Cut-off Values The cut-off values shall generally be the following six kinds:

0.08, 0.25, 0.8, 2.5, 8, 25 Unit: mm 3.1.4 Standard Values of Cut-off Values The standard values of the cut-off value, unless otherwise specified, shall be in accordance with the divisions in Table 1.

TABLE 1

Standard Values of Cut-off Value in Determining Center-line Mean Roughness

| Range of center-line mean roughness | | Cut-off value |
|---|---|---|
| Exceeding | Max. | mm |
| | 12.5 $\mu$m $R_a$ | 0.80 |
| 12.5 $\mu$m Ra | 100 $\mu$m $R_a$ | 2.50 |

Remark: Center-line mean roughness shall be determined by firstly designating the cut-off values. In carrying out the designation or instruction of the surface roughness, as it is inconvenient to designate that on all such occasions, unless otherwise required to specify, values of this table shall be used.

3.1.5 Measuring Length The measuring length shall generally be a value of three times or more the cut-off value.

3.2 Indication of Center-line Mean Roughness ($R_a$)

3.2.1 Designation of Center-line Mean Roughness The designation of the center-line means roughness shall be as follows:

| Center-line mean roughness___ $\mu$m | Cut-off value___ m | Measuring length___ mm |
|---|---|---|
| or | | |
| _____ $\mu$m $R_a$ | $\lambda_c$ _____ mm | _____ mm |

Remarks 1. In the case where the value of the center-line mean roughness obtained by using the standard value of the cut-off value given in Table 1 is in the range shown in Table 1, the designation of the cut-off value may be omitted.

2. In the case where the measuring length is three times or more the cut-off value, the designation of the measuring length may be omitted.

3.2.2 Preferred Number Series of Center-Line Mean Roughness When the surface roughness is designated by the center-line mean roughness, unless otherwise required, the preferred number series of Table 2 shall be used.

TABLE 2

Preferred Number Series of Center-line Mean Roughness

| | | |
|---|---|---|
| 0.013 | 0.4 | 12.5 |
| 0.25 | 0.8 | 25 |
| 0.05 | 1.6 | 50 |
| 0.1 | 3.2 | 100 |
| 0.2 | 6.3 | — |

3.2.3 Maximum Value Designation for Center-Line Mean Roughness In the case where the surface roughness is designated by the permissible maximum value for the center-line mean roughness, it shall be represented by the numerical value selected from the preferred number series of Table 2, suffixing a.

Remarks 1. The permissible maximum value mentioned here shall be an arithmetic mean value of $R_a$ on several points randomly ex-extracted from the indicated surface, but shall not be the maximum value of individual $R_a$ value.

2. The maximum value designation of the center-line mean roughness for example 6.3a means 0 $\mu$m $R_a \leqq 6.3a \leqq 6.3$ $\mu m R_a$.
3. For the cut-off value in the case of the maximum value designation of the center-line mean roughness, a value corresponding to the maximum value in Table 1 shall generally be used. When any cut-off value other than this value is to be used, this value shall be appended.

3.2.4 Sectional Designation for Center-Line Mean Roughness If it is required to designate a center-line mean roughness in certain section, numerical values corresponding to the upper limit (that of the larger designation value) and a lower limit (that of the smaller designation value) shall be stated additionally by selecting from Table 2.

EXAMPLE 1

In the Case where Standard Values of Cut-off Values for Upper Limit and Lower Limit (Table 1) Are Equal A sectional designation when the upper limit of 6.3 $\mu m R_a$ and the lower limit of 1.6 $\mu m R_a$ shall be designated as (6.3 to 1.6)a. In this case, 0.8 mm shall be used for the cut-off value.

EXAMPLE 2

In the Case where Standard Values of Cut-off Values for Upper Limit and Lower Limit (Table 1) Are Different A sectional designation when the upper limit of 25 $\mu m R_a$ and the lower limit of 6.3 $\mu m R_a$ shall be designated as (25 to 6.3)a. In this case, it means that a center-line mean roughness measured by a cut-off value of 2.5 mm is 25 $\mu m R_a$ or under, and that a center-line mean roughness measured by a cut-off value of 0.8 mm is 6.3 $\mu m R_a$ or over.

Remarks: 1. In the case where it is required to equalize the cut-off values corresponding to the upper and the lower limits, or in the case where cut-off values other than standard values of Table 1 is to be used, the cut-off value shall be appended. In the case of Example 2, when the cut-off value corresponding to the upper and the lower limits is taken is 2.5 mm, it shall be designated as (25 to 6.3)a $\lambda_c$ 2.5 mm.

2. Center-line mean roughness of the upper and the lower limits mentioned here shall be the arithmetic mean values of $R_a$ at several points sampled randomly from the designated surface, but shall not be the maximum value of individual $R_a$ values.

Dynamic Hardness:

A sample formed on a 7059 glass was used so that the dynamic hardness upon load of 0.1 gf was measured by a dynamic hardness tester (DUH-201 produced by Shimadzu Corporation). As a triangular pyramid shaped presser (edge angle of 115°) made of diamond was employed.

The results obtained in the above experiments are shown below.

Image Smearing:

The number of sheets required for recovering the image smearing after the stop for five hours was decided for each stage on the basis of A to D. The results of the five drums manufactured in Example 1 and one drum manufactured under the respective conditions of Comparative Example 1 as well as the measured results of the dynamic hardness of the first surface layer were shown in Table 5. As shown in Table 5, the good results were obtained for all the drums manufactured in Example 1. It was recognized that the hardness of the first surface layer of each drum was harder than the second surface layer.

Measurement of Film Thickness of Surface Layer After Endurance:

The film thickness of the second surface layer was measured before endurance and after the endurance of 100000 sheets and the results were shown in Table 6.

As apparent from the results of the Table 6, the second surface layer was scraped off by the electrophotographic processes during an endurance test.

Measurement of Contact Angle of the Surface After Endurance Test:

Assuming that a contact angle before the endurance test is 1, the contact angle after the endurance test is relatively compared therewith.

As shown in Table 7, it can be understood that the contact angle of the drums manufactured in Example 1 is not lowered even after they undergo the endurance test.

Evaluation of Fusion of Toner:

The results of the respective drums were shown in Table 8. The evaluation of the fusion was carried out on the basis of the relative comparison between the surface layers of the drums in Example 1 and the surface layer of the drum in the Comparative Example in accordance with the previously described method. The degree of fusion was divided into the ranks of A to D and the results thereof were shown in Table. As shown in Table 8, good results were obtained in the respective drums.

Measurement of Surface Roughness:

The measured results of five kinds of surface roughness of the first surface layers were shown in Table 9. As shown in the Table 9, it can be recognized that the above described surface roughness is located within the range of the present invention.

As shown in the above Tables, the drums according to the present invention exhibited good results in the respective items. This is greatly related to a fact that the second surface layer remaining in the recessed parts of the first surface layer after the endurance (after the second surface layer is scraped off) permits the good results of the contact angle after the endurance and the toner fusion test after the endurance to be gained. Actually, as a result of the ESCA analysis of the surface of the drum after endurance, it was recognized that F atoms remained. Further, it was simultaneously recognized that a part of the film of the first surface layer was exposed on the surface.

EXAMPLE 2

The system shown in FIG. 4 was employed and a 7059 glass (produced by Corning Inc.) was set on a cylindrical aluminium substrate so that a sample was formed under conditions shown in Table 10. The hardness of the manufactured sample was measured by the dynamic hardness tester (DUH-201 produced by Shimadzu Corporation).

The conditions were selected on the basis of the value of the dynamic hardness thus obtained, and the electrophotographic photosensitive members were produced under the same conditions and the same evaluation as those of Example 1 except that the first surface layers difference in hardness were formed. At the same time, we also formed the electrophotographic photosensitive members for measuring the surface roughness which were formed with layers from the substrates to the first surface layers in the same procedure. It was recognized that the surface roughness of each of the first surface layers was located within the range of the present invention.

The drums manufactured in such a way as well as the values of the hardness of the 7059 samples were shown in Table 11.

As shown in Table 11, the drums falling within a condition that the dynamic hardness of the first surface layer is located within a range of 300 to 1000 kgf/mm$^2$ exhibited excellent results in all the items.

EXAMPLE 3

The system shown in FIG. 4 was employed like Example 2 and a 7059 glass (produced by Corning Inc.) was set on a cylindrical aluminium substrate to form a sample under conditions shown in Table 12. The hardness of the produced sample was measured by the dynamic hardness tester (DUH-201 produced by Shimadzu Corporation).

The conditions were selected on the basis of the values of the dynamic hardness thus gained and the electrophotographic photosensitive members were formed and the same evaluation was carried out under the same conditions as those of Example 1 except that the second surface layers different in hardness were formed under these conditions thus selected. The condition of the first surface layer is 1B.

The drums formed in such a manner as well as the values of the 7059 sample were shown in Table 13.

As apparent from the Table 13, the drums falling within a condition that the dynamic hardness of the second surface layer is located within a range of 10 to 500 kgf/mm$^2$ exhibited good results for the respective items.

EXAMPLE 4

Another plasma CVD system illustrated in FIG. 5 was employed and a charge injection blocking layer and a photoconductive layer were successively laminated on a cylindrical A1 substrate under the same conditions of those of Example 1. Then, the manufacturing conditions of a first surface layer were changed under conditions shown in Table 14, the surface roughness of the formed drum was measured.

Drums were selected on the basis of the value of the surface roughness thus obtained, the second surface layer equal to that of Example 1 was formed again on these drums, the same evaluation was carried out and the results thereof as well as the values of the surface roughness were shown in Table 15.

At the same time, a 7059 glass (produced by Corning Inc.) was set to a cylindrical aluminium substrate to measure the dynamic hardness and samples were formed under the conditions of the Table 14. It was recognized that the dynamic hardness measured in the samples was respectively harder than that of the second surface layer.

As shown in the Table 15, the drums falling within a condition that the center line average surface roughness (Ra) of the first surface layers is located within a range of 50 to 5000 Å achieves good results in all the items.

EXAMPLE 5

The system shown in FIG. 4 was employed and a crystal silicone wafer was set to a cylindrical aluminium substrate so that a sample was formed under conditions shown in Table 16. The quantity of hydrogen contained in the film of the sample thus formed was estimated by a HFS (forward scattering analysis of hydrogen).

The conditions were selected on the basis of the analyzed results thus gained and the electrophotographic photosensitive members were formed under the same conditions as those of Example 1 and the same evaluation was carried out except that the first surface layer were formed under these selected conditions. It was recognized that the surface roughness of the first surface layers and the hardness of the first and second surface layers were located within the ranges of the present invention.

As shown in Table 17, when the content of hydrogen, H/(C+H) (atomic ratio) of the first surface layers was located within a range of 10 to 60%, good results could be acquired.

EXAMPLE 6

The system shown in FIG. 4 was employed and a crystal silicone wafer was set to a cylindrical A1 substrate similarly to Example 5 so that a sample was formed under conditions shown in Table 18. The content of fluorine in the film of the sample thus formed was estimated by an ESCA analysis.

The conditions were selected on the basis of the analyzed results thus obtained, the electrophotographic photosensitive members were formed under the same conditions as those of Example 1 and the same evaluation was carried out except that the second surface layer was formed under these selected conditions. At this time, the first surface layers were formed under the conditions of 1C of Example 1. It was recognized that the hardness of the second surface layer was lower than that of the first surface layer.

As shown in Table 19, when the content of fluorine, F/(C+F) (atomic ratio) of the second surface layer was located within a range of 6 to 50%, excellent results could be achieved.

EXAMPLE 7

The drums were formed under the same conditions as those of Example 1 and the same evaluation as that of Example 1 was carried out except that a photoconductive layer was divided into a charge transport layer and a charge generating layer depending on function. As a result, even when the configuration of the layer was formed with a function separate type comprising the charge transport layer and the charge generating layer, it was recognized that good results could be obtained in respect of all items.

EXAMPLE 8

A charge injection blocking layer and a photoconductive layer were successively laminated on a cylindrical A1 substrate under conditions shown in Table 20 by employing the plasma CVD system shown in FIG. 4. A procedure for forming a film was based on the above described procedure. Subsequently, first layers composed of the a-SiN:H film were laminated thereon under conditions shown in Table 21, and further, a second surface layer was laminated on the respective first surface layers under conditions shown in Table 22 to obtain a total of five electrophotographic photosensitive members 2A to 2E.

Further, five electrophotographic photosensitive members for measuring the surface roughness which were formed from substrates to first surface layers were formed at the same time in accordance with the same procedure.

The dynamic hardness of the second surface layer measured in accordance with a method described below was 125 kgf/mm$^2$.

EXAMPLE 9

Similarly to Example 8, the plasma CVD system illustrated in FIG. 4 was employed and a charge injection blocking layer and a photoconductive layer were successively laminated on a cylindrical A1 substrate under the conditions shown in the Table 20. Subsequently, first surface layers composed of the a-SiO:H film were laminated thereon under conditions shown in Table 23 and, further, the second surface layer was laminated respectively on the first surface layers under the conditions shown in the Table 22 to form electrophotographic photosensitive members 2F to 2J.

Further, the electrophotographic photosensitive members including from the substrates to the first surface layers for measuring the surface roughness were formed at the same time in accordance with the same procedure.

COMPARATIVE EXAMPLE 2

By using the plasma CVD system shown in FIG. 4, a charge injection blocking layer and a photoconductive layer were successively laminated on a cylindrical A1 substrate under the same conditions shown in the Table 20 like Example 1. Subsequently, a surface layers of a single layer made of the a-SiC:H film was laminated thereon under conditions shown in Table 24 to produce an electrophotographic photosensitive member.

The electrophotographic photosensitive members of Examples 8 and 9 and Comparative Example 2 thus produced were evaluated as mentioned below.

Image Smearing:

The electrophotographic photosensitive member was installed on an acceleration tester in which the electrophotographic apparatus (NP 6060 produced by Canon Inc.) was modified for an experiment and 20000 sheets of test charts (parts No: FY 919058) produced by Canon Inc. were copied under an environment of high temperature of 32° C./high humidity of 80% without heating a drum. Then, a copying machine was temporarily stopped. Under this state, the temperature was changed to 35° C. and the humidity was changed to 90% and the copying machine was left as it was for 5 hours.

After that, the above mentioned copying operation of the above described 20000 sheets of test charts and the stopping operation of the copying machine for 5 hours were repeated to obtain a total of 100000 copied sheets with endurance.

An image smearing was decided by discriminating the outlines of the characters of images thus obtained and it was decided on which sheet of all the sheets the image smearing of the copied images was recovered after the stop of the-copying machine for five hours.

Measurement of Contact Angle of Surface After Endurance:

Water droplet was placed on the surface of the electrophotographic photosensitive member carrying out the above described endurance to measure the contact angle between the drum and the water droplet and compare it with a value before the endurance.

Evaluation of Fusion of Toner:

The pushing pressure of the cleaning blade of the electrophotographic apparatus (NP6060 produced by Canon Inc.) was set to ⅓ times as high as the previous pressure and the surface temperature of the drum was set to 60° C., so that an environment in which the fusion was apt to be generated was created. The drum subjected to the endurance of 100000 copied sheets was installed on the acceleration tester modified as described above and the endurance of 100000 sheets was carried out by employing original of 1% (an original for copying on which only a straight line is drawn in the diagonal direction of a sheet of A4 size).

After the endurance, a halftone image was copied to examine the presence or absence of fusion. Specifically, in the halftone image on the sheet of A4 size, an area parallel to the direction of the bus line of the drum was prepared, the number of black points due to the fusion of the toner existing in the area was estimated and the results of six copied samples were obtained.

The obtained results were decided on the basis of the relative values to the values acquired from the similar test for the surface layer of Comparative Example 2 (the drum formed in Comparative Example 2). Assuming that the value of the drum formed in Comparative Example 2 is 50, the obtained results were evaluated on the basis of the number of points ranging from 1 to 100. When the number of points is smaller than 50, this denotes that the fusion is less than the surface layer of Comparative Example 2. When the number of points is larger than 50, this denotes that the obtained surface layer is worse in its quality than the surface layer of Comparative Example 2.

Measurement of Surface Roughness:

The electrophotographic photosensitive member for measuring the surface roughness which was formed with layers including from the substrate to the first surface layer was cut about 2 cm square, and the surface thereof was observed by an atmospheric probe microscope (Qscope Model 250 produced by Quesant Co., Ltd.). Data thus gained was analyzed to obtain a center line average surface roughness (Ra) on the basis of JIS B0601.

Dynamic Hardness:

A sample formed on a 7059 glass was used so that the dynamic hardness upon load of 0.1 gf was measured by a dynamic hardness tester (DUH-201 produced by Shimadzu Corporation). A triangular pyramid shaped presser (edge angle of 115°) made of diamond was employed.

The results obtained from the above described experiments will be described hereinbelow.

Image Smearing:

The number of sheets required for recovering the image smearing after the stop of the copying machine for five hours was decided for each stage on the basis of A to D. The results of the five drums manufactured in Example 8 and the drum manufactured under the respective conditions of Comparative Example 2 as well as the measured results of the dynamic hardness of the first surface layers were shown in Table 25.

As shown in Table 25, the good results were obtained for all the drums manufactured in this Example. Further, it was recognized that the hardness of the first surface layer of each drum was larger than that of the second surface layer.

Measurement of Contact Angle of the Surface After Endurance:

Assuming that a contact angle before the endurance test is 1, the contact angle after the endurance test is relatively compared therewith.

As shown in Table 26, it can be understood that the contact angle of the drums manufactured in Examples 8 and 9 is not lowered even after they undergo the endurance test.

Evaluation of Fusion of Toner:

The results of the respective drums were shown in Table 27. The evaluation of the fusion was carried out on the basis of the above described relative comparison. The degree of fusion was divided into the ranks of A to D and the results thereof were shown in the Table. As shown in Table 27, good results were obtained in the respective drums.

Measurement of Surface Roughness:

The measured results of five kinds of surface roughness of the first surface layers were shown in Table 28. As shown in the Table 28, it can be recognized that the above described surface roughness is located within the range of the present invention.

As shown in the above Table, the drums falling within a condition in which the center line average surface roughness (Ra) of the first surface layers was located within a range of 50 to 5000 Å exhibited good results in the respective items.

This is greatly related to a fact that the second surface layer remains in the recessed parts of the first surface layer after the endurance. Actually, as a result of the ESCA analysis performed on the surface of the drum after endurance, it was recognized that the second surface layer remained and F atoms remained from the analyzed result of the composition thereof. Further, it was simultaneously recognized that a part of the film of the first surface layer was exposed on the surface in accordance with a two-dimensional mapping.

EXAMPLE 10

The system shown in FIG. 4 was employed, electrophotographic photosensitive members 2K to 2Q were formed on a cylindrical aluminium substrate under the same conditions as those of Example 8 and further a second surface layer was formed under the same conditions shown in the Table 22, except that first surface layers were formed under the conditions shown in the Table 29. At the same time, electrophotographic photosensitive members for measuring the surface roughness including the substrate to the first surface layers were formed in the same procedure and it was recognized that the surface roughness of each of the first surface layers was located within the range of the present invention. Further, for measuring the dynamic hardness, a 7059 glass (produced by Corning Inc.) was set on a cylindrical aluminium substrate to form a sample made of the a-SiN:H film under conditions shown in Table 29.

The electrophotographic photosensitive members and the samples thus obtained were evaluated as described below.

Image Smearing:

An evaluation was carried out in a similar manner as to that of Example 8.

Evaluation of the Fusion of Toner:

An evaluation was conducted similarly to Example 8.

Dynamic Hardness:

An evaluation was carried out in the same manner as that of Example 8.

Measurement of Abrasion Loss on Surface Layer During Endurance:

While the evaluation of an image smearing with endurance was carried out, the electrophotographic photosensitive member was taken out from the copying machine at regular intervals of 20000 sheets and the film thickness of the surface layer was measured by employing a spectral reflection meter (CL-3000R produced by Otsuka Electronics Co., Ltd.). Then, each abrasion loss was calculated and shown in terms of the abrasion loss of the photosensitive member per 1000 sheets of A4 size for a transverse feed on the basis of the previously known film thickness of the second surface layer and the first surface layer.

The evaluation results mentioned above were shown together in Table 30.

As shown in the Table 30, the drums falling in a condition that the dynamic hardness of the first surface layer is located within a range of 300 to 1000 kgf/mm$^2$ exhibited good results in all items. Further, it was understood that the abrasion loss of the second surface layer of the present invention was 0.1 Å to 100 Å and the first surface layer was hardly worn, hence a performance was not deteriorated thereby.

EXAMPLE 11

The system illustrated in FIG. 4 was used and electrophotographic photosensitive members 2R to 2Y were formed on a cylindrical aluminium substrate under the same conditions as those of Example 8 except that a second surface layer was formed under conditions shown in Table 31. In this case, the conditions of the first surface layers were based on those of the drum 2A.

The surface roughness (Ra) of the first surface layer was about 60 Å on the basis of the results of Example 8. Further, the dynamic hardness thereof was 700 kgf/mm$^2$. Further, a 7059 glass (produced by Corning Inc.) was set to a cylindrical aluminium substrate for measuring dynamic hardness to form a sample of a second surface layer under the conditions shown in the Table 31.

The electrophotographic photosensitive members and the sample thus gained were evaluated in the same manner as that of Example 10. The evaluation results were shown in Table 32.

As shown in the Table 32, the drums falling in a condition that the dynamic hardness of the second surface layer was located within a range of 10 to 500 kgf/mm$^2$ showed satisfactory results in the respective items. Further, it could be understood that the abrasion loss of the second surface layer of the present invention was 0.1 Å to 100 Å and the first surface layers were not substantially worn.

EXAMPLE 12

Another plasma CVD system illustrated in FIG. 5 was used and a charge injection blocking layer, a photoconductive layer, a first surface layer and a second surface layer were successively laminated on a cylindrical A1 substrate under conditions shown in Table 33. Further, a photosensitive member comprising from a substrate to a first surface layer formed in accordance with the same manufacturing conditions was formed to measure the surface roughness. Further, the samples of the first surface layer and the second surface layer were formed under conditions shown in Table 33 by setting a 7059 glass (produced by Corning Inc.) on the cylindrical aluminium substrate. The dynamic hardness of the formed samples was measured by the dynamic hardness tester (DUH-201 produced by Shimadzu Corporation).

The photosensitive member thus obtained was evaluated in the same manner as that of Example 8. The results were shown in Table 34 together with the surface roughness of the first surface layer and the dynamic hardness of the first surface layer and the second surface layer.

As shown in the Table 34, it was apparent that the provision of the configuration of layers and the surface roughness according to the present invention permitted to show excellent results even when a different system was employed.

EXAMPLE 13

The system illustrated in FIG. 4 was employed and a crystal silicone wafer was set on a cylindrical A1 substrate to form the samples 2A to 2E of the first surface layers composed of the a-SiN:H film under the conditions shown in the Table 21 in accordance with the same procedure as that of Example 1. Further, the samples 2F to 2I of the first surface layers composed of the a-SiO:H film under the conditions shown in the Table 23 were formed in accordance with the same procedure as that of Example 9.

The content of hydrogen contained in the films of the produced samples was estimated by the HFS (hydrogen forward scattering analysis). The obtained results are shown in Table 35.

As shown in the Table 35, more improved results could be obtained when the content of hydrogen, H/(C+H)(atomic ratio) in the first surface layer was 10 to 50%.

EXAMPLE 14

The system shown in FIG. 4 was used and a crystal silicon wafer was set to a cylindrical A1 substrate to form the samples 2R to 2Y of the second surface layers composed of the a-C:F film under the conditions shown in the Table 31 in accordance with the same procedure as Example 11.

The content of fluorine in the films of the produced samples was estimated in accordance with the ESCA analysis. The results were shown in Table 36.

As shown in the Table 36, good results could be acquired when the content of fluorine, F/(C+F) (atomic ratio) in the second surface layer was 6 to 50%.

As mentioned above, according to the present invention, it is possible to provide an electrophotographic photosensitive member excellent in its repeated use in an electrophotographic apparatus, and an electrophotographic apparatus having the above photosensitive member.

Further, according to the present invention, it is possible to provide an electrophotographic photosensitive member capable of providing a stable image in which an image dimness or an image smearing or the like is not generated irrespective of an environment even when heating means is not provided, and an electrophotographic apparatus using the above described electrophotographic photosensitive member.

Still further, according to the present invention, it is possible to provide an electrophotographic photosensitive member excellent in its cleaning characteristic even when a toner having a small particle size and an excellent fixing characteristic is used, and in which a problem resulting from the fusion of the toner is not generated, or is neglectible, and an electrophotographic apparatus using the above described photosensitive member.

In addition, according to the present invention, the above described effects can be stably obtained by providing a second surface layer composed of a non-single-crystal carbon containing fluorine on a first surface layer with a center line average roughness (Ra) of 50 Å to 5000 Å.

TABLE 1

Manufacturing conditions of photosensitive member (charge injection blocking layer to photoconductive layer)

| | Kinds of gas and other items | Flow rate of gas and other conditions |
|---|---|---|
| Charge injection blocking layer | $SiH_4$ | 350 sccm |
| | $H_2$ | 500 sccm |
| | $B_2H_6$ | 2000 ppm (for $SiH_4$) |
| | NO | 5 sccm |
| | High frequency power | 100 W |
| | Internal pressure | 50 Pa |
| | Substrate temperature | 250° C. |
| | Film thickness | 1 μm |
| Photoconductive layer | $SiH_4$ | 400 sccm |
| | $H_2$ | 400 sccm |
| | High frequency power | 550 W |
| | Internal pressure | 65 Pa |
| | Substrate temperature | 250° C. |
| | Film thickness | 20 μm |

TABLE 2

Forming conditions of first surface layer

| | 1A | 1B | 1C | 1D | 1E |
|---|---|---|---|---|---|
| $CH_4$ | 100 sccm | 100 sccm | 100 sccm | 100 sccm | 200 sccm |
| $H_2$ | 100 sccm | 100 sccm | 0 sccm | 0 sccm | 0 sccm |
| High frequency power | 500 W | 1000 W | 500 W | 1000 W | 200 W |
| Internal pressure | 50 Pa | 50 Pa | 50 Pa | 50 Pa | 50 Pa |
| Substrate temperature | 250° C. | 250° C. | 250° C. | 250° C. | 250° C. |
| Film thickness | 2000 Å | 2000 Å | 2000 Å | 2000 Å | 2000 Å |

TABLE 3

Forming conditions of second surface layer

| Kinds of gas and other items | Flow rate of gas and other conditions |
|---|---|
| $CH_4$ | 100 sccm |
| $CF_4$ | 100 sccm |
| $H_2$ | 100 sccm |

TABLE 3-continued

| Forming conditions of second surface layer | |
|---|---|
| Kinds of gas and other items | Flow rate of gas and other conditions |
| High frequency power | 500 W |
| Internal pressure | 50 Pa |
| Substrate temperature | 250° C. |
| Film thickness | 1000 Å |

TABLE 4

| Forming conditions of a-SiC surface layer | |
|---|---|
| Kinds of gas and other items | Flow rate of gas and other conditions |
| $CH_4$ | 500 sccm |
| $SiH_4$ | 20 sccm |
| High frequency power | 200 W |
| Internal pressure | 50 Pa |
| Substrate temperature | 250° C. |
| Film thickness | 3000 Å |

TABLE 5

| Evaluation of the number of sheets with recovery of image smearing | | | | | | |
|---|---|---|---|---|---|---|
| Number of sheets of endurance | Example 1 | | | | | |
| | Drum 1A | Drum 1B | Drum 1C | Drum 1D | Drum 1E | Comparative Example 1 |
| 20000 | A | A | A | A | A | D* |
| 40000 | A | A | A | A | A | D |
| 60000 | A | A | A | A | A | D |
| 80000 | A | A | A | A | B | D |
| 100000 | B | A | A | A | B | D |
| Dynamic hardness of first surface layer ($kgf/mm^2$) | 550 | 960 | 740 | 820 | 310 | — |

*In Comparative Example 1, an image smearing is generated during endurance.

Decision reference

Recovery within 50 sheets . . . A

Recovery within a range of 50 to 100 sheets . . . B

Recovery within a range of 100 to 300 sheets . . . C

May not be possibly recovered even for 300 sheets . . . D

TABLE 6

| Measurement of film thickness of second surface layer | | | | | | |
|---|---|---|---|---|---|---|
| | Example 1 | | | | | |
| | Drum 1A | Drum 1B | Drum 1C | Drum 1D | Drum 1E | Comparative Example 1 |
| Before endurance | 2020 Å | 2005 Å | 1995 Å | 2025 Å | 1995 Å | 3005 Å |
| After endurance | 0 Å | 0 Å | 0 Å | 0 Å | 0 Å | 1800 Å |

TABLE 7

| Contact angle of the surface after endurance test | | | | | | |
|---|---|---|---|---|---|---|
| | Example 1 | | | | | Comparative |
| | Drum 1A | Drum 1B | Drum 1C | Drum 1D | Drum 1E | Example 1 |
| Before endurance | 1 | 1 | 1 | 1 | 1 | 1 |
| *After endurance | 0.91 | 1.00 | 1.00 | 0.98 | 0.81 | 0.35 |

*Contact angle after endurance (°)/contact angle before endurance (°)

TABLE 8

Evaluation of fusion of toner

| | Example 1 | | | | | |
|---|---|---|---|---|---|---|
| | Drum 1A | Drum 1B | Drum 1C | Drum 1D | Drum 1E | Comparative Example 1 |
| Rank of fusion | A | A | A | A | A | C* |

*Assuming that the result of the Comparative Example 1 is 50, a relative comparison is performed.

Decision reference 10 or smaller . . . A 10 to 30 . . . B 30 to 50 . . . C 50 or larger . . . D

TABLE 9

Measurement of surface roughness

| | Example 1 | | | | | |
|---|---|---|---|---|---|---|
| | Drum 1A | Drum 1B | Drum 1C | Drum 1D | Drum 1E | Comparative Example 1 |
| *Surface roughness | 440–610 Å | 1200–1300 Å | 720–800 Å | 180–280 Å | 1300–1450 Å | 550–790 Å |

*Center line average surface roughness (Ra) on the basis of JIS BO601

TABLE 10

Manufacturing conditions of first surface layer

| Kinds of gas and other items | Flow rate of gas and other conditions |
|---|---|
| $CH_4$ | 100 sccm |
| $H_2$ | Change from 0 to 1000 sccm |
| High frequency power | Change from 100 to 1000 W |
| Internal pressure | 50 Pa |
| Substrate temperature | 250° C. |

TABLE 11

Evaluation of results of Example 2

| | | Drum 1F | Drum 1G | Drum 1H | Drum 1I | Drum 1J |
|---|---|---|---|---|---|---|
| Dynamic hardness (kgf/mm$^2$) of first surface layer | | 203 | 300 | 515 | 1000 | 1220 |
| Image smearing | | | | | | |
| Number of sheets of endurance | 20000 | A | A | A | A | A |
| | 40000 | A | A | A | A | A |
| | 60000 | A | A | A | A | A |
| | 80000 | B | A | A | A | A |
| | 100000 | C | A | A | A | A |
| Film thickness of second surface layer after endurance | | 0 Å | 0 Å | 0 Å | 0 Å | 0 Å |
| Contact angle* | | 0.7 | 0.98 | 1.00 | 1.00 | 1.00 |
| Rank of fusion | | A | A | A | A | B |

*Contact angle after endurance (°)/contact angle before endurance (°)

TABLE 12

Manufacturing conditions of second surface layer

| Kinds of gas and other items | Flow rate of gas and other conditions |
|---|---|
| $CF_4$ | Change from 20 to 200 sccm |
| $H_2$ | 100 sccm |
| High frequency power | Change from 100 to 1000 W |
| Frequency | 13.56 MHz |
| Film thickness | 50 Pa |
| Substrate temperature | 250° C. |

TABLE 13

Evaluation of results of Example 3

| | | Drum 1F | Drum 1G | Drum 1H | Drum 1I | Drum 1J |
|---|---|---|---|---|---|---|
| Dynamic hardness (kgf/mm$^2$) of second surface layer | | 8 | 10 | 220 | 500 | 530 |
| Image smearing | | | | | | |
| Number of sheets of endurance | 20000 | A** | A | A | A | A |
| | 40000 | A | A | A | A | A |
| | 60000 | A | A | A | A | A |
| | 80000 | B | A | A | A | A |
| | 100000 | C | B | A | A | A |
| Film thickness of second surface layer after endurance | | 0 Å | 0 Å | 0 Å | 0 Å | 0 Å |
| Contact angle* | | 0.77 | 0.84 | 0.98 | 0.99 | 0.96 |
| Rank of fusion | | A | A | A | A | B |

*Contact angle after endurance (°)/contact angle before endurance (°)

**Recognition of vein shaped cuts

TABLE 14

Manufacturing conditions of first surface layer

| Kinds of gas and other items | Flow rate of gas and other conditions |
|---|---|
| $CH_4$ | 100 sccm |
| $H_2$ | Change from 0 to 1000 sccm |
| High frequency power | Change from 100 to 1000 W |
| Frequency | 1–450 MHz |
| Internal pressure | 50 Pa |
| Substrate temperature | 250° C. |

TABLE 15

Evaluation of results of Example 4

| | | Drum 1K | Drum 1L | Drum 1M | Drum 1N | Drum 1O |
|---|---|---|---|---|---|---|
| Surface roughness of first surface layer* | | 13 Å | 50 Å | 980 Å | 4980 Å | 7500 Å |
| Image smearing | | | | | | |
| Number of sheets after endurance | 20000 | A | A | A | A | A |
| | 40000 | B | A | A | A | A |
| | 60000 | B | A | A | A | A |
| | 80000 | C | A | A | A | B |
| | 100000 | C | B | A | A | B |

TABLE 15-continued

Evaluation of results of Example 4

| | Drum 1K | Drum 1L | Drum 1M | Drum 1N | Drum 1O |
|---|---|---|---|---|---|
| Film thickness of second surface layer after endurance | 0 Å | 0 Å | 0 Å | 0 Å | 0 Å |
| Contact angle* | 0.66 | 0.86 | 0.98 | 0.90 | 0.85 |
| Rank of fusion | B | A | A | A | B |

*Center line average surface roughness (Ra) on the basis of JIS BO601

TABLE 16

Manufacturing conditions of first surface layer

| Kinds of gas and other items | Flow rate of gas and other conditions |
|---|---|
| $CH_4$ | 100 sccm |
| $H_2$ | Change from 0 to 1000 sccm |
| High frequency power | Change from 100 to 1000 W |
| Internal pressure | 50 Pa |
| Substrate temperature | 250° C. |

TABLE 17

Evaluation of results of Example 5

| | | Drum 1P | Drum 1Q | Drum 1R | Drum 1S | Drum 1T |
|---|---|---|---|---|---|---|
| Content of hydrogen in first surface layer (%) | | 9 | 10 | 40 | 55 | 62 |
| Image smearing | | | | | | |
| Number of sheets after endurance | 20000 | A | A | A | A | A |
| | 40000 | A | A | A | A | A |
| | 60000 | A | A | A | A | A |
| | 80000 | A | A | A | A | A |
| | 100000 | A | A | A | A | B |
| Film thickness of second surface layer after endurance | | 0 Å | 0 Å | 0 Å | 0 Å | 0 Å |
| Contact angle* | | 0.99 | 0.98 | 1.00 | 1.00 | 0.9 |
| Rank of fusion | | B | A | A | A | A |

*Contact angle after endurance (°)/contact angle before endurance (°)

TABLE 18

Manufacturing conditions of second surface layer

| Kinds of gas and other items | Flow rate of gas and other conditions |
|---|---|
| $CH_4$ | 100 sccm |
| $CF_4$ | Change from 0 to 1000 sccm |
| $H_2$ | 100 sccm |
| High frequency power | Change from 100 to 1000 W |
| Internal pressure | 50 Pa |
| Substrate temperature | 250° C. |

TABLE 19

Evaluation of results of Example 6

| | | Drum IU | Drum 1V | Drum 1W | Drum 1X | Drum 1Y |
|---|---|---|---|---|---|---|
| Content of fluorine in second surface layer (atomic %) | | 6 | 15 | 30 | 50 | 55 |
| Image smearing | | | | | | |
| Number of sheets after endurance | 20000 | A | A | A | A | A |
| | 40000 | A | A | A | A | A |
| | 60000 | A | A | A | A | A |
| | 80000 | A | A | A | A | A |
| | 100000 | B | A | A | A | B |
| Film thickness of second surface layer after endurance | | 0 Å | 0 Å | 0 Å | 0 Å | 0 Å |
| Contact angle* | | 0.87 | 0.98 | 1.00 | 1.00 | 1.00 |
| Rank of fusion | | A | A | A | A | B |

*Contact angle after endurance (°)/contact angle before endurance (°)

TABLE 20

Manufacturing conditions of photosensitive member (charge injection blocking layer to photoconductive layer)

| | Kinds of gas and other items | Setting value |
|---|---|---|
| Charge injection blocking layer | $SiH_4$ | 350 sccm |
| | $H_2$ | 500 sccm |
| | $B_2H_6$ | 2000 ppm (for $SiH_4$) |
| | NO | 5 sccm |
| | High frequency power | 100 W |
| | Internal pressure | 50 Pa |
| | Substrate temperature | 250° C. |
| | Film thickness | 1 μm |
| Photo-conductive layer | $SiH_4$ | 400 sccm |
| | $H_2$ | 400 sccm |
| | High frequency power | 550 W |
| | Internal pressure | 65 Pa |
| | Substrate temperature | 250° C. |
| | Film thickness | 20 μm |

TABLE 21

Forming conditions of first surface layer

| | 2A | 2B | 2C | 2D | 2E |
|---|---|---|---|---|---|
| $SiH_4$ | 100 sccm | 100 sccm | 100 sccm | 150 sccm | 200 sccm |
| $N_2$ | 500 sccm | 300 sccm | 100 sccm | 500 sccm | 500 sccm |

TABLE 21-continued

| Forming conditions of first surface layer | 2A | 2B | 2C | 2D | 2E |
|---|---|---|---|---|---|
| High frequency power | 500 W | 1000 W | 500 W | 1000 W | 1000 W |
| Internal pressure | 50 Pa | 50 Pa | 50 Pa | 50 Pa | 50 Pa |
| Substrate temperature | 250° C. | 250° C. | 250° C. | 250° C. | 250° C. |
| Film thickness | 5000 Å | 5000 Å | 5000 Å | 5000 Å | 5000 Å |

TABLE 22

| Forming conditions of second surface layer | |
|---|---|
| Kinds of gas and other items | Setting value |
| $CH_4$ | 100 sccm |
| $CF_4$ | 100 sccm |
| $H_2$ | 100 sccm |
| High frequency power | 500 W |
| Internal pressure | 50 Pa |
| Substrate temperature | 250° C. |
| Film thickness | 1000 Å |

TABLE 23

| Manufacturing conditions of a-SiC:H surface layer | 2F | 2G | 2H | 2I | 2J |
|---|---|---|---|---|---|
| $SiH_4$ | 200 sccm | 100 sccm | 100 sccm | 150 sccm | 200 sccm |
| $O_2$/He (10%) | 50 sccm | 50 sccm | 100 sccm | 500 sccm | 500 sccm |
| High frequency power | 200 W | 200 W | 500 W | 1000 W | 1000 W |
| Internal pressure | 50 Pa | 50 Pa | 50 Pa | 50 Pa | 50 Pa |
| Substrate temperature | 250° C. | 250° C. | 250° C. | 250° C. | 250° C. |
| Film thickness | 5000 Å | 5000 Å | 5000 Å | 5000 Å | 5000 Å |

TABLE 24

| Forming conditions of a-SiC:H surface layer | |
|---|---|
| Kinds of gas and other items | Setting value |
| $SiH_4$ | 50 sccm |
| $CH_4$ | 500 sccm |
| High frequency power | 200 W |
| Internal pressure | 50 Pa |
| Substrate temperature | 250° C. |
| Film thickness | 5000 Å |

TABLE 25

| Evaluation of number of sheets required for recovery of image smearing | Example 8 | | | | | Example 9 | | | | | |
|---|---|---|---|---|---|---|---|---|---|---|---|
| Number of sheets subject to endurance | Drum 2A | Drum 2B | Drum 2C | Drum 2D | Drum 2E | Drum 2F | Drum 2G | Drum 2H | Drum 2I | Drum 2J | Comparative Example 2 |
| 2000 | A | A | A | A | A | A | A | A | A | A | D* |
| 4000 | A | A | A | A | A | A | A | A | A | A | D |

TABLE 25-continued

Evaluation of number of sheets required for recovery of image smearing

| Number of sheets subject to endurance | Example 8 | | | | | Example 9 | | | | | Comparative Example 2 |
|---|---|---|---|---|---|---|---|---|---|---|---|
| | Drum 2A | Drum 2B | Drum 2C | Drum 2D | Drum 2E | Drum 2F | Drum 2G | Drum 2H | Drum 2I | Drum 2J | |
| 6000 | A | A | A | A | A | A | A | A | A | A | D |
| 8000 | B | A | B | A | A | B | B | A | A | A | D |
| 10000 | B | A | B | A | A | B | B | B | A | B | D |
| Dynamic hardness of first surface layer ($Kgf/mm^2$) | 450 | 850 | 300 | 900 | 700 | 300 | 350 | 550 | 780 | 650 | — |

*In Comparative Example 2, image smearing is generated during endurance

Decision reference

Recovery within 50 sheets . . . A

Recovery within a range of 50 to 100 sheets . . . B

Recovery within a range of 100 to 300 sheets . . . C

May not be possibly recovered even for 300th sheet . . . D

TABLE 26

Contact angle of the surface after endurance

| | Example 8 | | | | | Example 9 | | | | | |
|---|---|---|---|---|---|---|---|---|---|---|---|
| | Drum 2A | Drum 2B | Drum 2C | Drum 2D | Drum 2E | Drum 2F | Drum 2G | Drum 2H | Drum 2I | Drum 2J | Comparative Example 2 |
| Contact angle after endurance | 0.85 | 0.92 | 0.84 | 0.95 | 0.94 | 0.82 | 0.84 | 0.91 | 0.97 | 0.92 | 0.35 |

*Contact angle after endurance (°)/contact angle before endurance (°)

TABLE 27

Evaluation of fusion of toner

| | Example 8 | | | | | Example 9 | | | | | |
|---|---|---|---|---|---|---|---|---|---|---|---|
| | Drum 2A | Drum 2B | Drum 2C | Drum 2D | Drum 2E | Drum 2F | Drum 2G | Drum 2H | Drum 2I | Drum 2J | Comparative Example 2 |
| Rank of fusion | A | A | A | A | A | A | A | A | A | A | C* |

*Assuming that the result of Comparative Example 1 is 50, a relative comparison is performed.

Decision reference 10 or smaller . . . A 10 to 30 . . . B 30 to 50 . . . C 50 or larger . . . D

TABLE 28

Measurement of surface roughness

| | Example 8 | | | | | Example 9 | | | | | |
|---|---|---|---|---|---|---|---|---|---|---|---|
| | Drum 2A | Drum 2B | Drum 2C | Drum 2D | Drum 2E | Drum 2F | Drum 2G | Drum 2H | Drum 2I | Drum 2J | Comparative Example 2 |
| Surface roughness (Å) | 60 | 240 | 1800 | 3200 | 4800 | 75 | 360 | 2200 | 3900 | 4900 | 3100 |

*Center line average surface roughness (Ra) on the basis of JIS BO601

TABLE 29

| | Manufacturing conditions of first surface layer | | | | | | |
|---|---|---|---|---|---|---|---|
| | 2K | 2L | 2M | 2N | 2O | 2P | 2Q |
| $SiH_4$ | 120 sccm | 120 sccm | 120 sccm | 180 sccm | 100 sccm | 200 sccm | 10 sccm |
| $N_2$ | 80 sccm | 120 sccm | 300 sccm | 500 sccm | 800 sccm | 50 sccm | 500 sccm |
| $H_2$ | 500 sccm | 500 sccm | 1000 sccm | 300 sccm | 500 sccm | 1000 sccm | 1000 sccm |
| High frequency power | 200 W | 500 W | 500 W | 1000 W | 1200 W | 100 W | 1500 W |
| Internal pressure | 66 Pa | 66 Pa | 66 Pa | 66 Pa | 66 Pa | 66 Pa | 66 Pa |
| Substrate temperature | 250° C. | 250° C. | 250° C. | 250° C. | 250° C. | 250° C. | 250° C. |
| Film thickness | 3000 Å | 3000 Å | 3000 Å | 3000 Å | 3000 Å | 3000 Å | 3000 Å |

TABLE 30

| Evaluation of results of Example 10 | | | | | | | | |
|---|---|---|---|---|---|---|---|---|
| | | Example 10 | | | | | | |
| | | Drum 2K | Drum 2L | Drum 2M | Drum 2N | Drum 2O | Drum 2P | Drum 2Q |
| Image smearing | 20000 | A | A | A | A | A | A | A |
| | 40000 | A | A | A | A | A | A | A |
| | 60000 | A | A | A | A | A | A | A |
| | 80000 | B | B | A | A | A | B | A |
| | 100000 | B | B | B | A | A | C | A |
| Rank of fusion | | A | A | A | A | A | A | B |
| Dynamic hardness of first surface layer ($kgf/mm^2$) | | 310 | 460 | 520 | 870 | 980 | 250 | 1200 |
| Abrasion loss of second surface layer (Å) | | 33 | 34 | 34 | 32 | 33 | 31 | 32 |
| Abrasion loss of first surface layer (Å) | | 0.01 | −0 | −0 | −0 | −0 | 0.02 | −0 |

TABLE 31

| | Manufacturing conditions of second surface layer | | | | | | |
|---|---|---|---|---|---|---|---|
| | 2R | 2S | 2T | 2U | 2V | 2W | 2Y |
| $CF_4$ | 100 sccm | 200 sccm | 100 sccm | 200 sccm | 100 sccm | 200 sccm | 300 sccm |
| $CH_4$ | 10 sccm | 200 sccm | 100 sccm | 50 sccm | 100 sccm | 10 sccm | 300 sccm |
| $H_2$ | 100 sccm | 200 sccm | 100 sccm | 0 sccm | 100 sccm | 100 sccm | 200 sccm |
| High frequency power | 500 W | 500 W | 500 W | 500 W | 1000 W | 100 W | 500 W |
| Internal pressure | 50 Pa | 50 Pa | 50 Pa | 50 Pa | 50 Pa | 50 Pa | 50 Pa |
| Substrate temperature | 250° C. | 250° C. | 250° C. | 250° C. | 250° C. | 250° C. | 250° C. |
| Film thickness | 2000 Å | 2000 Å | 2000 Å | 2000 Å | 2000 Å | 2000 Å | 2000 Å |

TABLE 32

Evaluation of results of Example 11

| | | Example 11 | | | | | | |
|---|---|---|---|---|---|---|---|---|
| | | Drum 2R | Drum 2S | Drum 2T | Drum 2U | Drum 2V | Drum 2W | Drum 2Y |
| Image smearing | 20000 | A | A | A | A | A | A | A |
| | 40000 | A | A | A | A | A | A | A |
| | 60000 | A | A | A | A | A | A | A |
| | 80000 | B | A | A | A | A | B | A |
| | 100000 | B | B | A | A | A | B | A |
| Rank of fusion | | A | A | A | A | A | A | B |
| Dynamic hardness of second surface layer (kgf/mm$^2$) | | 12 | 65 | 125 | 310 | 480 | 7 | 560 |
| Abrasion loss of second surface layer (Å) | | 96 | 61 | 33 | 2.3 | 0.15 | 120 | 0.05 |
| Abrasion loss of first surface layer (Å) | | −0 | −0 | −0 | −0 | −0 | −0 | −0 |

TABLE 33

Production conditions of photosensitive member (charge injection blocking layer to second surface layer)

| Name of layer | Kinds of gas and other items | Setting value |
|---|---|---|
| Charge injection blocking layer | $SiH_4$ | 200 sccm |
| | $H_2$ | 500 sccm |
| | $B_2H_6$ | 1000 ppm (for $SiH_4$) |
| | NO | 10 sccm |
| | High frequency power (105 MHz) | 130 W |
| | Internal pressure | 2 Pa |
| | Substrate temperature | 250° C. |
| | Film thickness | 2 μm |
| Photoconductive layer | $SiH_4$ | 200 sccm |
| | $H_2$ | 500 sccm |
| | High frequency power (105 MHz) | 550 W |
| | Internal pressure | 2 Pa |
| | Substrate temperature | 250° C. |
| | Film thickness | 20 μm |
| First surface layer | $SiH_4$ | 100 sccm |
| | $N_2$ | 300 sccm |
| | High frequency power (105 MHz) | 500 W |
| | Internal pressure | 2 Pa |
| | Substrate temperature | 250° C. |
| | Film thickness | 30000 Å |
| Second surface layer | $CH_4$ | 50 sccm |
| | $CF_4$ | 100 sccm |
| | $H_2$ | 100 sccm |
| | High frequency power (105 MHz) | 500 W |
| | Internal pressure | 2 Pa |
| | Substrate temperature | 250° C. |
| | Film thickness | 2000 Å |

TABLE 34

Evaluation of results of Example 12

| | | Example 12 |
|---|---|---|
| Image smearing | 20000 | A |
| | 40000 | A |
| | 60000 | A |

TABLE 34-continued

Evaluation of results of Example 12

| | Example 12 |
|---|---|
| 80000 | A |
| 100000 | A |
| Contact angle after Endurance | 0.82 |

TABLE 34-continued

Evaluation of results of Example 12

| | Example 12 |
|---|---|
| Rank of fusion | A |
| Surface roughness* (Å) | 620 |
| Dynamic hardness of the first surface layer(kgf/mm$^2$) | 750 |
| Dynamic hardness of the second surface layer(kgf/mm$^2$) | 120 |

*Center line average surface roughness (Ra) on the basis of JIS BO601

TABLE 35

Content of hydrogen in film of first surface layer

| | Example 8 | | | | | Example 9 | | | | |
|---|---|---|---|---|---|---|---|---|---|---|
| | 2A | 2B | 2C | 2D | 2E | 2F | 2G | 2H | 2I | 2J |
| Content of hydrogen in film (atomic %) | 17 | 12 | 49 | 32 | 24 | 48 | 33 | 21 | 11 | 14 |

TABLE 36

Content of fluorine in film of second surface layer

| | Example 11 | | | | | | |
|---|---|---|---|---|---|---|---|
| | 2R | 2S | 2T | 2U | 2V | 2W | 2Y |
| Content of fluorine in film (atomic %) | 35 | 28 | 14 | 48 | 6 | 45 | 25 |

What is claimed is:

1. An electrophotographic photosensitive member comprising:

a photoconductive layer comprising a non-single-crystal material containing silicon atoms as a matrix on an electrically conductive cylindrical substrate;

a first surface layer having a dynamic hardness from 300 to 1000 kgf/mm$^2$ and comprising a non-single-crystal material; and a second surface layer having a dynamic hardness from 10 to 500 kgf/mm$^2$ and comprising a non-single-crystal carbon containing at least fluorine, these layers being successively formed in this order, wherein the dynamic hardness of the first surface layer is larger than that of the second surface layer and the center line average surface roughness (Ra) of the first surface layer is 50 to 5000 Å.

2. The electrophotographic photosensitive member according to claim 1, wherein first surface layer comprises an amorphous C:H film comprising carbon and hydrogen.

3. The electrophotographic photosensitive member according to claim 1, wherein first surface layer comprises an amorphous carbon film comprising carbon.

4. The electrophotographic photosensitive member according to claim 1, wherein the first surface layer comprises an amorphous SiN:H film comprising silicon, hydrogen and nitrogen or an amorphous SiO:H film comprising silicon, hydrogen and oxygen.

5. The electrophotographic photosensitive member according to claim 1, wherein the first surface layer is an amorphous SiN:H film, wherein the content of the hydrogen atoms contained in the film is 10 to 50% based on H/(Si+H+N).

6. The electrophotographic photosensitive member according to claim 1, wherein the second surface layer has a fluorine atom content from 6 to 50% based on F/(C+F).

7. The electrophotographic photosensitive member according to claim 1, wherein the first surface layer comprises a non-single-crystal carbon containing 10 to 60% of H/(C+H) as an atomic ratio and the second surface layer comprises the non-single-crystal carbon containing 6 to 50% of F/(C+F) as an atomic ratio.

8. The electrophotographic photosensitive member according to claim 1, wherein the second surface layer is worn by rotating the electrophotographic photosensitive member and sequentially repeating electrophotographic processes of charging, exposure, developing, transferring and cleaning.

9. The electrophotographic photosensitive member according to claim 1, wherein the second surface layer is worn by 0.1 Å to 100 Å per 1000 sheets of A4 size for transverse feed by rotating the electrophotographic photosensitive member and sequentially repeating the electrophotographic processes of charging, exposure, developing, transferring and cleaning.

10. The electrophotographic photosensitive member according to claim 1, wherein a part of the first surface layer is exposed on the surface of the electrophotographic photosensitive member by rotating the electrophotographic photosensitive member and sequentially repeating the electrophotographic processes of charging, exposure, developing, transferring and cleaning.

11. The electrophotographic photosensitive member according to claim 10, wherein the first surface layer exposed on the surface of the electrophotographic photosensitive member is less worn than the second surface layer by rotating the electrophotographic photosensitive member and sequentially repeating the electrophotographic processes charging, exposure, developing, transferring and cleaning.

12. The electrophotographic photosensitive member according to claim 1, wherein at least the first surface layer is formed by decomposing a feed gas by plasma CVD using a high frequency of 1 to 450 MHZ.

13. The electrophotographic photosensitive member according to claim 1, wherein at least the first surface layer is formed by decomposing a feed gas by plasma CVD using a high frequency of 50 to 450 MHZ.

14. The electrophotographic photosensitive member according to claim 1, wherein at least the second surface layer is formed by decomposing a feed gas by plasma CVD using a high frequency of 1 to 450 MHZ.

15. The electrophotographic photosensitive member according to claim 1, wherein at least the second surface layer is formed by decomposing a feed gas by plasma CVD using a high frequency of 50 to 450 MHZ.

16. The electrophotographic apparatus comprising the electrophotographic photosensitive member according to claim 1, a charger, an exposing means, a developer, transfer means and a cleaner.

* * * * *

UNITED STATES PATENT AND TRADEMARK OFFICE

CERTIFICATE OF CORRECTION

PATENT NO. : 6,406,824 B1
DATED : June 18, 2002
INVENTOR(S) : Ryuji Okamura et al.

It is certified that error appears in the above-identified patent and that said Letters Patent is hereby corrected as shown below:

Column 1,
Line 29, “a;wavelength” should read -- a wavelength --; and
Line 60, “carbon,atoms” should read -- carbon atoms --.

Column 4,
Line 59, “is” should read -- is a --.

Column 7,
Line 7, “the:first” should read -- the first --; and
Line 22, “what is called,” should be deleted.

Column 8,
Line 24, “gap band” should read -- band gap --.

Column 10,
Line 19, “and-the” should read -- and the --; and
Line 39, “cannot” should read -- there cannot --.

Column 11,
Line 10, “the;” should read -- the --; and
Line 62, “be,divided” should read -- be divided --.

Column 14,
Line 12, “to which the high” should read -- at a --;
Line 40, “voltage” should read -- voltage is applied --;
Line 42, “reach” should read -- reaches --; and
Line 63, “A1” should read -- Al --.

Column 15,
Line 16, “A1” should read -- Al --.

Column 18,
Line 28, “length ____” should read -- length ____ mm --;
Line 29, “mm” should be deleted;
Line 31, “$\lambda_c$____ mm” should read -- “$\lambda_c$____ mm $1_c$____ mm --;
Line 32, “____ mm” should be deleted; and
Line 64, “ex-extracted” should read -- extracted --.

UNITED STATES PATENT AND TRADEMARK OFFICE

CERTIFICATE OF CORRECTION

PATENT NO. : 6,406,824 B1
DATED : June 18, 2002
INVENTOR(S) : Ryuji Okamura et al.

It is certified that error appears in the above-identified patent and that said Letters Patent is hereby corrected as shown below:

Column 19,
Line 35, “roughness” should read -- roughness is --;
Line 40, “is” should read -- are --; and
Line 55, “As a” should read -- A --.

Column 20,
Line 27, “Table.” should read -- Table 8. --.

Column 21,
Line 35, “A1” should read -- Al --; and
Line 59, “silicone” should read -- silicon --.

Column 22,
Line 2, “layer” should read -- layers --;
Line 13, “silicone” should read -- silicon --; and “A1” should read -- Al --; and
Line 46, “A1” should read -- Al --.

Column 23,
Line 2, “A1” should read -- Al --;
Line 16, “A1” should read -- Al --;
Line 18, “layers” should read -- layer --; and
Line 48, “Water” should read -- A water --.

Column 25,
Line 18, “further a” should read -- a further --.

Column 26,
Line 32, “A1” should read -- Al --; and
Line 60, “silicone” should read -- silicon --; and “A1” should read -- Al --.

Column 27,
Line 13, “A1” should read -- Al --.

Column 33,
Table 15, “BO601” should read -- B0601 --.

UNITED STATES PATENT AND TRADEMARK OFFICE

CERTIFICATE OF CORRECTION

PATENT NO. : 6,406,824 B1
DATED : June 18, 2002
INVENTOR(S) : Ryuji Okamura et al.

It is certified that error appears in the above-identified patent and that said Letters Patent is hereby corrected as shown below:

Column 35,
Table 23, “a-SiC:H” should read -- a-SiO:H --.

Column 37,
Table 28, “BO601” should read -- B0601 --.

Column 43,
Table 34, “BO601” should read -- B0601 --;
Line 54, “first” should read -- the first --; and
Line 57, “first” should read -- the first --.

Column 44,
Line 41, “charging” should read -- of charging --.

Signed and Sealed this

Tenth Day of December, 2002

JAMES E. ROGAN
*Director of the United States Patent and Trademark Office*